US010825677B2

(12) United States Patent
Green et al.

(10) Patent No.: US 10,825,677 B2
(45) Date of Patent: Nov. 3, 2020

(54) MASS SPECTROMETRY WITH INCREASED DUTY CYCLE

(71) Applicant: Micromass UK Limited, Wilmslow (GB)

(72) Inventors: Martin Raymond Green, Bowdon (GB); Jason Lee Wildgoose, Stockport (GB); Keith Richardson, High Peak (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 16/604,852

(22) PCT Filed: Apr. 12, 2018

(86) PCT No.: PCT/GB2018/050970
§ 371 (c)(1),
(2) Date: Oct. 11, 2019

(87) PCT Pub. No.: WO2018/189542
PCT Pub. Date: Oct. 18, 2018

(65) Prior Publication Data

US 2020/0075307 A1 Mar. 5, 2020

(30) Foreign Application Priority Data

Apr. 13, 2017 (GB) ..... 1706011.2

(51) Int. Cl.
*H01J 49/42* (2006.01)

(52) U.S. Cl.
CPC ..... *H01J 49/427* (2013.01)

(58) Field of Classification Search
CPC ..... H01J 49/00; H01J 49/427
(Continued)

(56) References Cited

U.S. PATENT DOCUMENTS 5,187,365 A 2/1993 Kelley
2009/0194688 A1 8/2009 Bateman et al.
(Continued)

FOREIGN PATENT DOCUMENTS

EP 2924712 A1 9/2015
GB 2421842 A 7/2006
(Continued)

OTHER PUBLICATIONS

Search Report for United Kingdom Patent Application No. GB1706011.2, dated Oct. 13, 2017, 3 pages.
(Continued)

*Primary Examiner* — Nicole M Ippolito

(57) ABSTRACT

A method of mass spectrometry is disclosed comprising: applying voltages to a mass filter or ion trap such that it is capable of transmitting or ejecting ions having mass to charge ratios within separate first and second mass to charge ratio windows; varying said voltages with time such that the first and second windows are moved simultaneously across different ranges of mass to charge ratio; detecting ions transmitted or ejected in the windows, or ions derived therefrom, with an ion detector; and deconvolving the resulting ion signal, wherein said deconvolving comprises: a) modelling an ion signal expected to be detected at the detector; b) comparing the model signal to the ion signal from the detector; and c) determining if the model signal matches the ion signal from the detector.

20 Claims, 12 Drawing Sheets

(58) Field of Classification Search
USPC ..... 250/281, 282, 283
See application file for complete search history.

(56) References Cited

U.S. PATENT DOCUMENTS

| | | | | |
|---|---|---|---|---|
| 2014/0117226 | A1 | 5/2014 | Giannakopulos | |
| 2015/0136969 | A1 | 5/2015 | Wildgoose | |
| 2016/0307745 | A1 | 10/2016 | Smith | |
| 2017/0205425 | A1* | 7/2017 | Yip | G01N 33/6848 |
| 2018/0174817 | A1* | 6/2018 | Green | H01J 49/067 |
| 2020/0051800 | A1* | 2/2020 | McAlister | H01J 49/065 |
| 2020/0116733 | A1* | 4/2020 | Baba | H01J 49/0072 |

FOREIGN PATENT DOCUMENTS

| | | | |
|---|---|---|---|
| GB | 2452350 | A | 3/2009 |
| WO | 2014/200987 | A2 | 12/2014 |

OTHER PUBLICATIONS

International Search Report and Written Opinion for International Application No. PCT/GB2018/050970, dated Jul. 19, 2018, 17 pages.

* cited by examiner

MASS SPECTROMETRY WITH INCREASED DUTY CYCLE

CROSS-REFERENCE TO RELATED APPLICATION

This application is a national phase filing claiming the benefit of and priority to International Patent Application No. PCT/GB2018/050970, filed on Apr. 12, 2018, which claims priority from and the benefit of United Kingdom patent application No. 1706011.2 filed on Apr. 13, 2017. The entire contents of these applications are incorporated herein by reference.

FIELD OF THE INVENTION

The present invention relates generally to mass spectrometers and in particular to spectrometers in which ions are selectively transmitted or ejected downstream by a mass filter or ion trap.

BACKGROUND

It is known to perform a data independent parallel MSMS experiment by scanning the mass to charge ratio range transmitted by a quadrupole mass filter in a mass to charge ratio resolving mode (or scanning the range of mass to charge ratios ejected from an analytical ion trap), fragmenting these ions and recording time of flight mass spectral data during the scan. For example, U.S. 2015/0136969 discloses such a method. Such methods produce two dimensional data sets that may be interrogated to produce MSMS spectra of all species present in the range of mass to charge ratios scanned.

By combining two data sets, one obtained with relatively low fragmentation energy such that precursor ions dominate and another obtained with high or varying fragmentation energy such that fragment ions dominate, precursor ions may be associated with their respective fragment ions with a very high degree of specificity. The appearance of precursor ions and their related fragment ions may be correlated as a function of the mass to charge ratio transmission window scan.

Continuously scanning the range of mass to charge ratios transmitted by the mass filter is particularly advantageous as it produces defined ion signal peaks that correspond to the time at which a particular precursor ion was transmitted. Centroiding or peak detecting these peaks allows correlation of fragment ions with their respective precursor ions with a higher precision than would be given by the width of the mass to charge ratio transmission window alone.

The sample being analysed may be chromatographically separated upstream of the mass filter (or ion trap) and the precursor ions may be correlated with their respective product ions based on their chromatographic retention time in addition to the time at which they were transmitted by the quadrupole mass filter (or ejected from the ion trap). Compared to associating precursor ions with fragment ions by chromatographic retention time alone (e.g. $MS^e$ techniques), this technique has the advantage of a much higher specificity, thus producing simplified and easily interpretable MS-MS spectra, reducing the probability of mass interference and producing more robust association of precursor ion mass to charge ratios with fragment ions.

However, in these techniques only a relatively small portion of the entire mass to charge ratio range is transmitted by the mass filter (or ejected from the ion trap) at any instant in time and so this technique suffers from a very low duty cycle.

It is desired to provide an improved mass spectrometer and an improved method of mass spectrometry.

SUMMARY

A first aspect of the present invention provides a method of mass spectrometry comprising:

providing ions to a mass filter or ion trap;

applying voltages to the mass filter or ion trap such that it is capable of transmitting or ejecting ions having mass to charge ratios within separate first and second mass to charge ratio windows;

varying said voltages with time such that the first and second windows are moved simultaneously across different ranges of mass to charge ratio;

detecting ions transmitted or ejected in the first and second mass to charge ratio windows, or ions derived therefrom, with an ion detector to obtain an ion signal; and deconvolving the ion signal detected at the detector, wherein said deconvolving comprises:

a) modelling at least one ion signal expected to be detected at the detector given at least one respective species of ion being provided to the mass filter or ion trap, so as to provide at least one respective model signal;

b) comparing the at least one model signal to the ion signal from the detector; and c) determining if the at least one model signal matches the ion signal from the detector.

It is known to scan a mass filter having a single mass to charge ratio transmission window. However, the use of multiple windows increases the duty cycle of the spectrometer for a given analysis time, as fewer ions are discarded as compared to when a single window is used. For example, if the windows scan different m/z ranges they may each be scanned at a relatively slow rate since each window need not scan the whole range of interest during the total scan time and hence a greater number of ions will be transmitted than if a single window was scanned over the entire range of interest. Also, if each of the windows scans the same m/z range, or overlapping ranges, the multiple windows transmit a greater combined number of ions than a single window would during the same total scan time. As a greater number of ions are transmitted, the resulting data can be analysed to obtain more precise spectral data and with a better signal to noise ratio.

The first and second windows are moved simultaneously for at least some time, but not necessarily all of the time.

Although first and second windows are described herein, it is contemplated that voltages may be applied to the mass filter or ion trap such that it is capable of transmitting or ejecting ions having mass to charge ratios within three, four, five or more separate mass to charge ratio windows. The voltages may be varied with time such that the windows are moved simultaneously across different ranges of mass to charge ratio.

Ions having mass to charge ratios outside of the windows at any given time are not transmitted or ejected by the mass filter or ion trap at that time.

The step of deconvolving the data may comprise a forward fitting technique.

Step a) above may comprise empirically modelling said at least one ion signal by: providing one or more known ion species to the mass filter or ion trap; measuring the ion signal detected at the detector in response thereto; and using the measured ion signal for the one or more known species as the model signal for that respective species.

Each of the known species may be empirically modelled separately by being supplied to the mass filter or ion trap separately. Alternatively, multiple known species may be supplied to the mass filter or ion trap together and empirically modelled together.

As alternative to empirical modelling, step a) may comprise looking up or calculating the at least one model signal for the at least one respective species of ion considered to have been provided to the mass filter or ion trap. For example, the step of modelling each model signal may comprise: defining a mass to charge ratio and intensity for each of said at least one species of ion considered to be provided to the mass filter or ion trap, and using knowledge of how the mass to charge ratio transmission or ejection functions of the first and second windows vary with time in the step of modelling the model signals for those species.

The variation of the mass to charge ratio transmission or ejection functions of the first and second windows with time may be known from knowledge of how the voltages applied to the mass filter or ion trap vary with time.

Steps a) and b) may comprise: defining or obtaining model signals for a plurality of said species of ions; superimposing the model signals to form a composite model signal; and comparing the composite signal to the ion signal from the detector; or defining or obtaining a model signal for only a single species of ion as a composite model signal, and comparing that signal to the ion signal from the detector.

The method may comprise calculating a goodness of fit between the composite model signal and the ion signal from the detector; wherein if the goodness of fit indicates that the composite model signal and said ion signal match to within a predetermined convergence criterion, then the composite model signal is considered to match the ion signal.

The convergence criterion may be a threshold probability or tolerance value.

The method may be an iterative method comprising the steps of: (i) modifying the amplitude and/or mass to charge ratio of one or more of said at least one species of ions modelled to provide said at least one model signal, (ii) comparing the resulting composite signal to the ion signal output from the detector, and (iii) calculating a goodness of fit between this composite signal and the ion signal output from the detector; wherein steps (i)-(iii) are repeatedly performed in an iterative manner until the goodness of fit between the composite signal and the ion signal output from the detector match to within said convergence criterion.

The iterative process may be a Markov Chain Monte Carlo method.

The convergence criterion may be maximum likelihood, maximum entropy, or maximum a posteriori (MAP).

The goodness of fit may be the probability of the detector output ion signal given the model signal(s).

The step of deconvolving the data comprises using a least squares or non-negative least squares algorithm; or a filter diagonalisation method.

When the composite model signal is considered to match the ion signal then said plurality of said species of ions, or said single species of ion, may be determined to have been transmitted or ejected by the first and/or second windows.

The method may comprise determining the mass to charge ratio of each of said species of ions determined to have been transmitted or ejected from its respective model signal; and optionally also determining the intensity of each of said species of ions determined to have been transmitted from its respective model signal.

The method may comprise determining, from its respective model signal, the time of transmission or ejection by said first and/or second windows of each of said species of ions that has been determined to have been transmitted or ejected.

This may enable the transmission or ejection time of each species to be determined accurately, because the use of the two windows allows a relatively high number of ions to be accounted for in the modelling. This relatively high accuracy may be useful, for example, if the ions are fragmented and/or reacted between the mass filter or ion trap and the detector, since the ejection or transmission time may be used to associate a given precursor ion with its fragment and/or product ions.

The ions transmitted or ejected by the first and second windows may be fragmented and/or reacted to produce fragment and/or product ions that are then detected by the ion detector to produce said ion signal.

The ions may be fragmented by any known method to produce fragment ions, such as CID, ETD, ECD etc. The ions may be reacted by any known method to produce product ions, such as being reacted with other ions or neutral molecules to produce the product ions.

The step of modelling each model signal may comprise assuming that the ion signal due to a given fragment and/or product ion being detected by the detector will have an intensity profile shape that follows the intensity profile shape of its respective precursor ion transmitted or ejected by the first and/or second window.

The method may comprise mass analysing the fragment and/or product ions to determine their mass to charge ratios and/or identity.

The method may comprise associating at least one of the fragment and/or product ions with its respective precursor ions transmitted or ejected by the first and/or second window based on the time of detection of the fragment and/or product ions and on how the mass to charge ratios capable of being transmitted or ejected in the first and/or second windows vary with time.

For example, as described above, the method may determine the time of transmission or ejection by said first and/or second windows of each of said species of ions that has been determined to have been transmitted or ejected, using its respective model signal. Each of these species of ion may then be associated with fragment and/or product ions that have been detected at substantially the same time as the time that the species was determined (using its respective model signal) to have been transmitted or ejected by the mass filter or ion trap.

Said at least one of the fragment and/or product ion may be associated with a respective precursor ion having a mass to charge ratio that is capable of being transmitted by the first and/or second window substantially at the time that said at least one of the fragment and/or product ions is detected.

The method may comprise associating at least one of the species of ions determined to have been transmitted by the first and/or second window with its respective fragment and/or product ions by matching the intensity profile shape of the model signal for this ion species with the intensity profile shape of the fragment and/or product ions detected at the detector.

The ions transmitted or ejected by the first and second windows may be substantially unfragmented and unreacted, and detected by the ion detector to provide said ion signal.

The ion detector may be the detector of a time or flight mass analyser, or the method may comprise separating ions according to mass to charge ratio between said mass filter or ion trap and said ion detector.

This allows the deconvolution technique to be simplified as model signals may be compared to a portion of the detector signal from a relatively narrow mass to charge ratio region of the spectra, in which relatively few ion species exist. Therefore, the signal is greatly simplified, resulting in more precise results in shorter timescales. For example, a first portion of the ion signal detected over a first range of elution times from the m/z separator (or over a first range of masses detected by the ToF mass analyser) may be subjected to the deconvolution technique described herein. A second portion of the ion signal detected over a second different range may be separately subjected to the deconvolution technique described herein. A third portion of the ion signal may be analysed in a corresponding way, and so on.

The ion signal may be filtered or otherwise processed to isolate a first portion of the ion signal that is associated with ions having a first range of mass to charge ratios, and said deconvolving may then be applied to said first portion of the ion signal.

A second portion of the ion signal associated with ions having a second different range of mass to charge ratios may be isolated and the deconvolving applied to that second portion of the ion signal.

The step of varying said voltages with time may progressively scan the first and second windows across one or more range of mass to charge ratios. The windows may therefore be moved smoothly and progressively with time. Alternatively, one or both of the windows may be stepped along the range of interest as time progresses.

The first window may be moved over a first range of mass to charge ratios and the second window may be moved over a second range of mass to charge ratios, wherein the first and second ranges at least partially overlap. Alternatively, the first window may be moved over a first range of mass to charge ratios and the second window may be moved over a second different range of mass to charge ratios, wherein the first and second ranges do not overlap.

In either case, the first window may be moved over a first range of mass to charge ratios and the second window may be moved over a second different range of mass to charge ratios, wherein the first and second ranges are different sizes.

The first window may be moved over a first range of mass to charge ratios during a first time period and the second window may be moved over a second range of mass to charge ratios during a second time period, wherein the second time period commences after the first time period commences; and/or wherein the second time period ends either before or after the first time period ends.

The first and second windows may be moved in the same direction of either increasing or decreasing mass to charge ratio; or one of the first and second windows may move in a direction of increasing mass to charge ratio and the other of the first and second windows may move in a direction of decreasing mass to charge ratio.

The first and second windows may be moved at different rates.

For example, the first window may be moved through its range at a first number of mass to charge ratio units per second and the second window may be moved through its range at a second, different number of the mass to charge ratio units per second.

As such, any given species of ions transmitted or ejected by the first window is transmitted or ejected over a different duration of time, or with a different time profile, to any given species of ion transmitted or ejected by the second window. If the transmitted or ejected ions are detected (or ions derived therefrom), then it may be determined which window transmitted or ejected any given detected ion (or its respective precursor ion) based on the duration of time that the ion is detected for or by its detection profile. The mass to charge ratio of that ion (or its respective precursor ion) can then be determined, e.g. based on the detection time or profile and the relationship of how the mass to charge ratios transmitted or ejected by the window vary as a function of time.

The width of the first window may be different to the width of the second window.

More specifically, the first window is capable of transmitting or ejecting ions having a first sized range of mass to charge ratios at any given time, and the second window is capable of transmitting or ejecting ions having a second sized range of mass to charge ratios at any given time, wherein the first and second sized ranges are different.

The method maybe performed during a single experimental run.

The method may comprise separating ions according to a physicochemical property, such as ion mobility, such that different ions arrive at the mass filter at different times.

According to the method described herein, either (i) the mass filter may be a notched mass filter, wherein a broadband frequency AC or RF voltage signal is applied to electrodes of the filter for exciting and ejecting ions from the filter, wherein said first and second windows are provided by arranging notches in the broadband frequency signal such that frequencies are absent from the broadband frequency signal, and wherein the values of the notched frequencies are varied with time such that the first and second windows move with time; or (ii) the ion trap may be a mass selective ion trap, wherein first voltages are applied to electrodes of the ion trap to trap ions therein, wherein said first and second windows are provided by applying AC or RF voltages to electrodes of the ion trap for exciting and ejecting ions from the ion trap, and wherein the frequencies of the AC or RF voltages are varied with time such that the first and second windows move with time.

The mass filter may comprise a multipole electrode rod set, such as a quadrupole rod set.

The first aspect of the invention also provides a mass spectrometer comprising:

a mass filter or ion trap having electrodes;

one or more voltage source for applying voltages to the electrodes;

an ion detector;

a controller set up and configured to: (i) control the one or more voltage source to apply voltages to the electrodes of the mass filter or ion trap such that it is capable of transmitting or ejecting ions having mass to charge ratios within separate first and second mass to charge ratio windows; (ii) vary the voltages applied to the electrodes with time such that the first and second windows are moved simultaneously across different ranges of mass to charge ratio for transmitting ions towards said detector; and a processor set up and configured to deconvolve an ion signal detected at the detector by: a) modelling at least one ion signal expected to be detected at the detector given at least one respective species of ion being provided to the mass filter or ion trap, so as to provide at least one respective model signal; b) comparing the at least one model signal to the ion signal from the detector; and c) determining if the at least one model signal matches the ion signal from the detector.

The mass spectrometer may be arranged and configured to perform any of the methods described herein.

For example, the controller may be set up and configured to control the one or more voltage source to vary the voltages applied to the electrodes with time such that the first and second windows are moved as described herein.

It is contemplated that the method and apparatus herein need not be limited to deconvolving the ion signal.

Accordingly, from a second aspect the present invention provides a method of mass spectrometry comprising:

providing ions to a mass filter or ion trap;

applying voltages to the mass filter or ion trap such that it is capable of transmitting or ejecting ions having mass to charge ratios within separate first and second mass to charge ratio windows;

varying said voltages with time such that the first and second windows are moved simultaneously across different ranges of mass to charge ratio; and detecting ions transmitted or ejected in the first and second mass to charge ratio windows, or ions derived therefrom, with an ion detector to obtain an ion signal.

The method may have any of the features described in relation to the first aspect of the present invention, except that it need not be limited to the features associated with deconvolving the ion signal. For example, the method may simply use peak detection algorithms instead (e.g. to determine peak start and end times, centroids or peak tops).

For example, the first window may be moved over a first range of mass to charge ratios and the second window may be moved over a second different range of mass to charge ratios, wherein the first and second ranges do not overlap.

The first window may be moved over a first range of mass to charge ratios and the second window may be moved over a second range of mass to charge ratios, wherein the first and second ranges at least partially overlap. Alternatively, the first window may be moved over a first range of mass to charge ratios and the second window may be moved over a second different range of mass to charge ratios, wherein the first and second ranges do not overlap.

In either case, the first window may be moved over a first range of mass to charge ratios and the second window may be moved over a second different range of mass to charge ratios, wherein the first and second ranges are different sizes.

The first window may be moved over a first range of mass to charge ratios during a first time period and the second window may be moved over a second range of mass to charge ratios during a second time period, wherein the second time period commences after the first time period commences; and/or wherein the second time period ends either before or after the first time period ends.

The first and second windows may be moved in the same direction of either increasing or decreasing mass to charge ratio; or one of the first and second windows may move in a direction of increasing mass to charge ratio and the other of the first and second windows may move in a direction of decreasing mass to charge ratio.

The first and second windows may be moved at different rates.

The width of the first window may be different to the width of the second window.

The method may comprise mass analysing and/or detecting ions transmitted or ejected by the first and second windows, or ions derived therefrom, to obtain an ion signal; and determining the portion of the ion signal resulting from the first window transmitting or ejecting ions and the portion of the ion signal resulting from the second window transmitting or ejecting ions.

The method may comprise determining the mass to charge ratio of one or more ion species transmitted or ejected by the first window based on the timing and/or profile of one or more peaks in the ion signal and the relationship of how the mass to charge ratios transmitted or ejected by the first window vary as a function of time; and/or determining the mass to charge ratio of one or more ion species transmitted or ejected by the second window based on the timing and/or profile of one or more peaks in the ion signal and the relationship of how the mass to charge ratios transmitted or ejected by the second window vary as a function of time.

The ions transmitted or ejected by the first and second windows may be fragmented or reacted so as to produce fragment or product ions. The fragment or product ions may be mass analysed and/or detected to provide said one or more peaks in the ion signal, and the fragment or product ions may be associated with their respective precursor ions based on the time of their mass analysis and/or detection and the relationship of how the mass to charge ratios transmitted or ejected by the first or second window varies as a function of time.

The second aspect of the present invention also provides a mass spectrometer comprising:

a mass filter or ion trap having electrodes;

one or more voltage source for applying voltages to the electrodes;

an ion detector; and a controller set up and configured to: (i) control the one or more voltage source to apply voltages to the electrodes of the mass filter or ion trap such that it is capable of transmitting or ejecting ions having mass to charge ratios within separate first and second mass to charge ratio windows; (ii) vary the voltages applied to the electrodes with time such that the first and second windows are moved simultaneously across different ranges of mass to charge ratio for transmitting ions towards said detector.

The mass spectrometer may be arranged and configured to perform any of the methods described herein.

The spectrometer disclosed herein may comprise an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; (xxviii) a Laser Ablation Electrospray Ionisation ("LAESI") ion source; and (xxix) Surface Assisted Laser Desorption Ionisation ("SALDI").

The spectrometer may comprise one or more continuous or pulsed ion sources.

The spectrometer may comprise one or more ion guides.

The spectrometer may comprise one or more ion mobility separation devices and/or one or more Field Asymmetric Ion Mobility Spectrometer devices.

The spectrometer may comprise one or more ion traps or one or more ion trapping regions.

The spectrometer may comprise one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

The spectrometer may comprise a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser.

The spectrometer may comprise one or more energy analysers or electrostatic energy analysers.

The spectrometer may comprise one or more ion detectors.

The spectrometer may comprise one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter.

The spectrometer may comprise a device or ion gate for pulsing ions; and/or a device for converting a substantially continuous ion beam into a pulsed ion beam.

The spectrometer may comprise a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser.

The spectrometer may comprise a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The spectrometer may comprise a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) >about 500 V peak to peak.

The AC or RF voltage may have a frequency selected from the group consisting of: (i) <about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) >about 10.0 MHz.

The spectrometer may comprise a chromatography or other separation device upstream of an ion source. The chromatography separation device may comprise a liquid chromatography or gas chromatography device. Alternatively, the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) <about 0.0001 mbar; (ii) about 0.0001-0.001 mbar; (iii) about 0.001-0.01 mbar; (iv)

about 0.01-0.1 mbar; (v) about 0.1-1 mbar; (vi) about 1-10 mbar; (vii) about 10-100 mbar; (viii) about 100-1000 mbar; and (ix) >about 1000 mbar.

Analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

The spectrometer may be operated in various modes of operation including a mass spectrometry ("MS") mode of operation; a tandem mass spectrometry ("MS/MS") mode of operation; a mode of operation in which parent or precursor ions are alternatively fragmented or reacted so as to produce fragment or product ions, and not fragmented or reacted or fragmented or reacted to a lesser degree; a Multiple Reaction Monitoring ("MRM") mode of operation; a Data Dependent Analysis ("DDA") mode of operation; a Data Independent Analysis ("DIA") mode of operation a Quantification mode of operation or an Ion Mobility Spectrometry ("IMS") mode of operation.

BRIEF DESCRIPTION OF THE DRAWINGS

Various embodiments will now be described, by way of example only, and with reference to the accompanying drawings in which.

DETAILED DESCRIPTION

Figure 1:
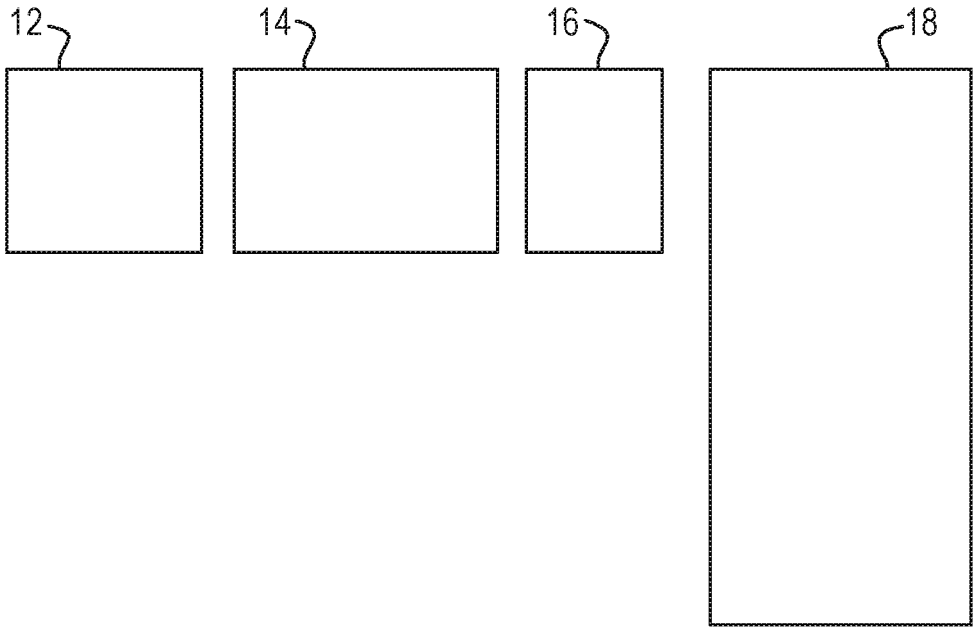
FIG. 1 shows a schematic of a mass spectrometer.

FIG. 1 shows a block diagram of a known instrument comprising an ion source 12, a quadrupole mass filter 14, a fragmentation or reaction cell 16 and an orthogonal acceleration time of flight mass analyser 18.

In operation, ions are generated by ion source 12 and pass to the quadrupole mass filter 14. Voltages are applied to the quadrupole mass filter 14 so that it is only capable of transmitting ions within a certain mass to charge ratio transmission window. Ions having mass to charge ratios outside this window are filtered out and not transmitted by the mass filter 14. Accordingly, the mass to charge ratios of the precursor ions that are transmitted by the mass filter are known. These ions then pass into the fragmentation or reaction cell 16 and are either fragmented or reacted with other ions or molecules therein so as to produce product ions. These product ions are onwardly transmitted to the time of flight mass analyser 18, in which they are mass analysed. The product ions detected by the time of flight mass analyser 18 can therefore be correlated with the mass to charge ratios of the precursor ions transmitted by the mass filter 14. The mass to charge ratio transmission window of the mass filter 14 may be scanned with time such that different ranges of mass to charge ratios are transmitted by the mass filter 14 at different times. The different precursor ions transmitted at different times may then be associated with their respective product ions.

However, as the mass filter 14 only transmits ions within a certain mass to charge ratio transmission window at any given instant, a large proportion of the ions are filtered out and the duty cycle of the instrument is relatively low.

According to various embodiments of the present invention, the mass filter 14 is substituted by a notched broadband mass filter such that the mass filter simultaneously provides a plurality of mass to charge ratio transmission windows. This may be used to increase the duty cycle of the instrument, since ions in different ranges of mass to charge ratios are able to be simultaneously transmitted by the mass filter.

In order to aid the understanding of the differences between a quadrupole ion guide, a quadrupole mass filter and a quadrupole notched mass filter, these devices will now be described with reference to FIGS. 2-5.

Figure 2:
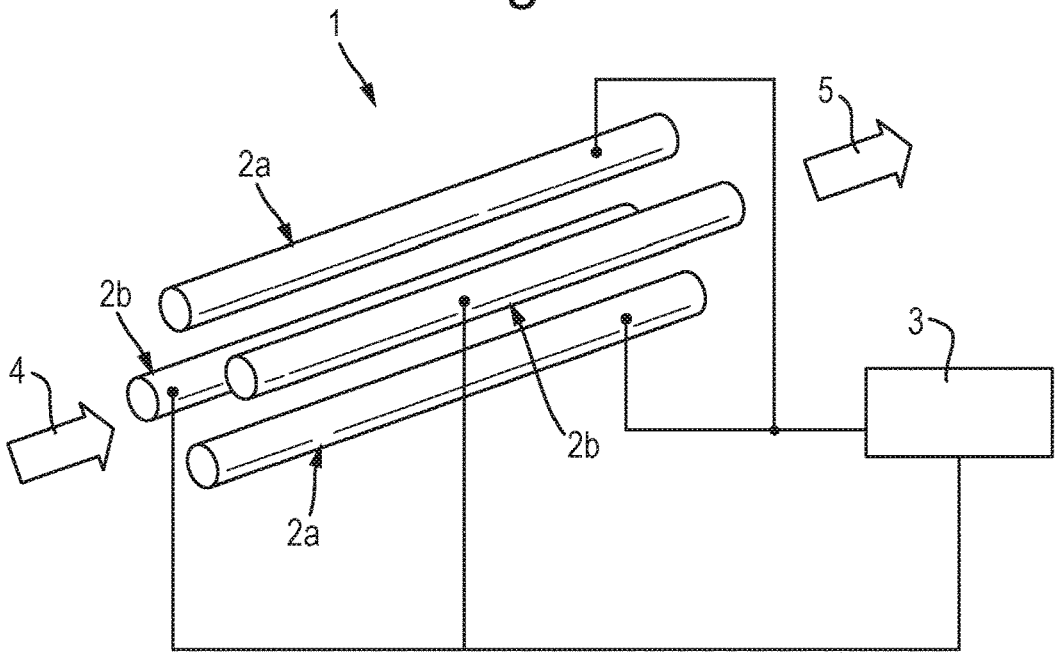
FIG. 2 shows a schematic of a conventional quadrupole ion guide.

FIG. 2 shows a schematic of a conventional quadrupole ion guide 1. The quadrupole rod set comprises four parallel rods 2*a*,2*b*. All four rods 2*a*,2*b* are maintained at substantially the same DC voltage. A two phase RF voltage supply 3 is connected to the rods 2*a*,2*b* such that adjacent rods have opposite phases of an RF voltage applied to them whilst diametrically opposed rods 2*a*;2*b* have the same phase RF voltage applied to them. The RF voltage applied to the rods 2*a*,2*b* creates a radial pseudo-potential well which acts to confine ions radially within the ion guide 1. Ions are not confined axially within the ion guide 1.

The conventional quadrupole rod set ion guide 1 transmits ions simultaneously through the ion guide 1 without substantially mass filtering the ions, at least to first approximation. Therefore, to a first approximation at least, substantially all the ions 4 received at the entrance to the ion guide 1 will be onwardly transmitted by the ion guide 1. As a result the composition of the beam of ions 5 which emerges from the exit of the ion guide 1 will be substantially similar to the composition of the beam of ions 4 which was initially received at the entrance to the ion guide 1.

The quadrupole rod set 1 may alternatively be operated as a mass filter or mass analyser by maintaining a DC potential difference between adjacent rods. When operated as a mass filter or mass analyser only ions having mass to charge ratios which fall within a certain mass to charge ratio transmission window will have stable trajectories through the mass filter. Accordingly, only those ions having mass to charge ratios which fall within the mass to charge ratio transmission window will be onwardly transmitted by the mass filter. All other ions will have unstable trajectories through the mass filter or mass analyser and hence will become lost to the system.

Figure 3:
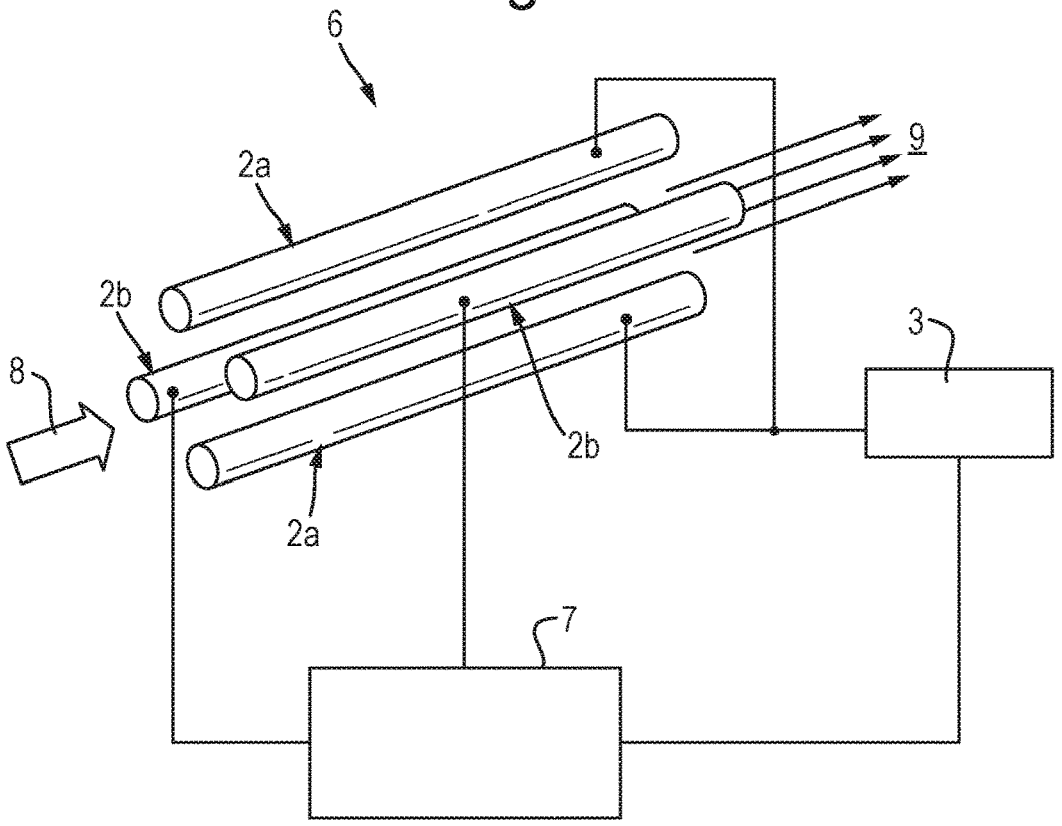
FIG. 3 shows a schematic of a notched mass filter.

FIG. 3 shows a schematic of a notched mass filter 6, which may be used in embodiments of the present invention. The notched mass device 6 comprises a quadrupole rod set, which may comprise four parallel rods 2*a*,2*b*. The rods 2*a*,2*b* may be connected to a two phase AC or RF voltage supply 3. Adjacent rods may be arranged so as to have opposite phases of an AC or RF voltage applied to them and diametrically opposed rods 2*a*,2*b* may be arranged so as to have the same phase of an AC or RF voltage applied to them. The AC or RF voltage applied to the rods 2*a*,2*b* creates a radial pseudo-potential well which acts to radially confine ions within the mass filter 6. A notched broadband frequency signal 7 is applied to at least some of the electrodes, optionally to an opposed pair of rods 2*a*,2*b*. The notched broadband frequency signal 7 may comprise a supplemental dipolar or quadrupolar waveform. The application of a notched broadband frequency signal 7 to the rods 2*a*,2*b* causes a majority of ions which are not desired to be onwardly transmitted by the mass filter 6 to be resonantly excited and radially ejected from the mass filter 6. The strength of the resonant excitation and radial movement of the undesired ions is sufficient to overcome the effect of the radial pseudo-potential well generated by the applied AC or RF voltage which otherwise seeks to radially confine ions within the mass filter 6.

The notches provided in the otherwise broadband frequency signal 7 are arranged such that there are some frequencies which are absent from the broadband frequency signal 7 that is applied to the rods 2*a*,2*b*. Ions having resonance or first harmonic frequencies which substantially correspond with the absent frequencies in the applied broadband frequency signal 7 will not therefore be resonantly excited by the applied broadband frequency signal 7. Accordingly, these ions will not be radially ejected from the mass filter 6. Consequently, these ions will therefore be substantially unaffected by the application of the broadband frequency signal 7 to the rods 2*a*,2*b* and will be onwardly transmitted by the mass filter 6. According to a less preferred embodiment the notched broadband frequency signal 7 which is applied to the rods 2*a*;2*b* may include relatively low amplitude frequency components which may resonantly excite analyte ions of interest but only to a relatively small or minor degree. The amplitude of these frequency components may be kept relatively low and hence the ions of interest are not sufficiently resonantly excited such that they are able to overcome the radially confining action of the radial pseudo-potential well resulting from the applied AC or RF voltage.

Accordingly, the broadband waveform 7 which is applied to the rods 2*a*,2*b* causes some or a majority of ions to be resonantly excited and radially ejected from the mass filter 6 whilst substantially not affecting one or more analyte ions of interest having certain specific mass to charge ratios which are desired to be radially retained within and onwardly transmitted by the mass filter 6. Where the broadband waveform 7 includes more than one notch, this creates more than one respective mass to charge ratio transmission window which may simultaneously transmit ions in parallel through the mass filter 6. The ions 9 which are simultaneously transmitted may constitute a subset or reduced set of the ions 8 received at the entrance to the mass filter 6. These transmitted ions 9 have a range of different and distinct mass to charge ratios. The mass filter 6 therefore transmits ions having a mass to charge ratio profile which is different to the mass to charge ratio profile of a conventional quadrupole rod set ion guide or a conventional quadrupole rod set mass filter operating in either a low or high resolution mode.

The broadband waveform 7 which is applied to a pair of rods 2*a*,2*b* may be generated by initially providing a broadband frequency signal and then removing certain specific frequency components from the broadband frequency signal. Those frequencies which are removed from the broadband frequency signal may correspond with the resonance or first harmonic frequencies of ions of interest which are desired to be onwardly transmitted by the mass filter 6.

Figure 4:
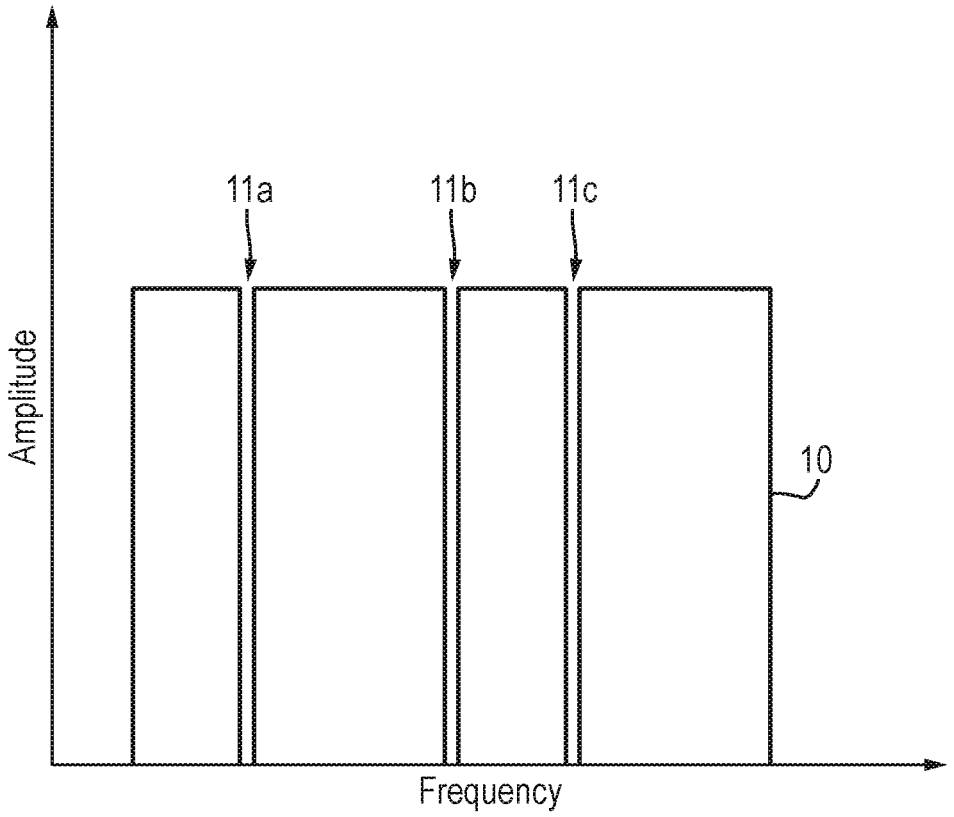
FIG. 4 shows an example of a notched broadband frequency signal which may be applied to the mass filter of FIG. 3.

FIG. 4 shows an example of a notched broadband frequency signal 10 which may be applied to the mass filter 6. The notched broadband frequency signal 10 is shown having a plurality of frequency notches 11*a*, 11*b*, 11*c* corresponding to the resonant or first harmonic frequency of certain species of analyte ions which are desired to be onwardly transmitted by the mass filter 6. The range of the broadband frequency signal 10 may be sufficiently wide such that all the undesired ions present in an ion beam 8 received by the mass filter 6 will be resonantly excited and radially ejected except for the ions of interest except for those ions having resonance frequencies which correspond with one of the frequency notches 11*a*;11*b*;11*c*.

Figure 5A:
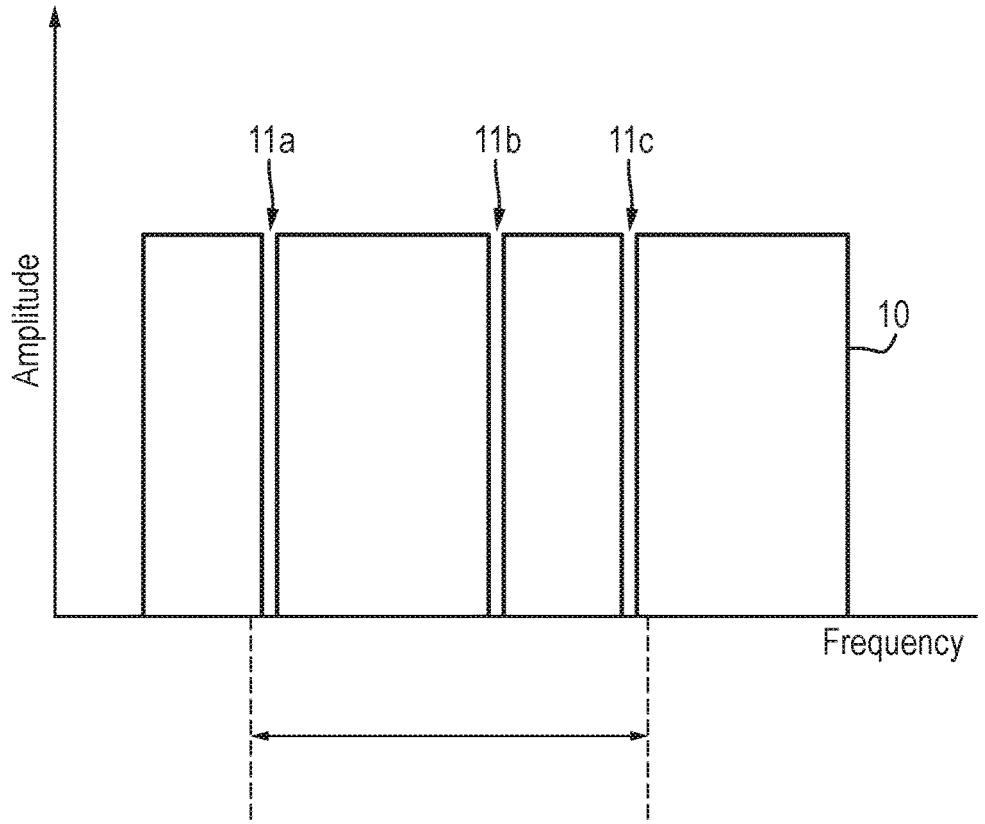
FIGS. 5A and 5B show frequency ranges of notched broadband frequency signals that may be applied to the mass filter of FIG. 3.

FIG. 5A shows the frequency range of the applied broadband frequency signal 10 that may be applied when all the rods are maintained at substantially the same DC voltage. The broadband frequency signal 10 may extend above and below the resonance frequency of the lowest and highest mass to charge ratio ions expected to be received into the mass filter 6. The notched broadband frequency signal 10 may therefore be arranged so as to potentially effectively resonantly excite and hence radially eject all the ions received into the mass filter 6 apart from those ions having a secular or resonance frequency which corresponds with a frequency notch 11*a*; 11*b*; 11*c* in the notched broadband frequency signal 10.

Figure 5B:
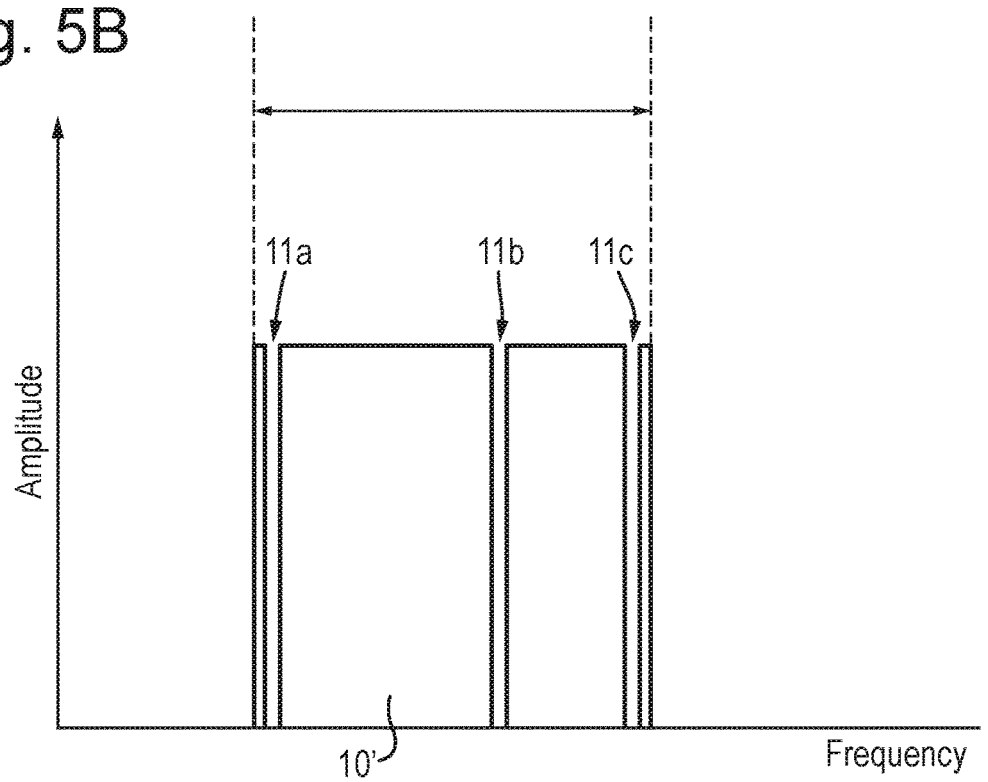

FIG. 5B shows the frequency range of the applied broadband frequency signal 10' that may be applied when the rods are maintained at different DC voltages, e.g. when adjacent rods are maintained at substantially equal and opposite DC voltages. According to this mode of operation the DC voltages result in only ions having certain mass to charge ratios within a mass to charge ratio transmission window to be capable of being transmitted by the quadrupole rod set 6, irrespective of the effect of applying a notched broadband frequency signal to the quadrupole rod set 6. This embodiment enables a notched broadband frequency signal 10' having a reduced range of frequencies to be applied to the quadrupole rod set 6 in order to remove unwanted ions whilst not substantially affecting the retention and onward transmission of analyte ions of interest. According to this embodiment ions can be considered as being subjected to two different effects. Firstly, due to the DC voltages, all ions having mass to charge ratios falling outside of the mass to charge ratio transmission window of the quadrupole rod set mass filter will be attenuated since these ions will have unstable trajectories through the quadrupole rod set and will become lost to the system. Secondly, those ions which do have mass to charge ratios falling within the transmission window of the quadrupole mass filter 6 are additionally subjected to the effect of a notched broadband frequency signal 10' which has a frequency range which generally or substantially corresponds with the mass to charge ratio transmission window of the quadrupole rod set mass filter 6.

Only those ions having resonance or fundamental harmonic frequencies which correspond with a frequency notch 11*a*, 11*b*,11*c* in the broadband frequency signal 10' will be onwardly transmitted. Others ions, even though they may have mass to charge ratios which fall within the mass to charge ratio transmission window of the quadrupole rod set mass filter, will be resonantly excited and radially ejected from the quadrupole rod set 6. Embodiments are also contemplated wherein the one or more mass to charge ratio transmissions windows created by the application of the notched broadband frequency signal may partially extend beyond, overlap or be contained wholly within the single mass to charge ratio transmission window of the quadrupole rod set mass filter (caused by the DC voltages).

Accordingly, embodiments of the present invention apply a notched broadband mass selective excitation waveform to the electrodes of a quadrupole mass filter in order to simultaneously provide the mass filter with multiple different mass to charge ratio transmission windows. The excitation may be dipolar or quadrupolar. This notching technique therefore enables a plurality of desired ions having different mass to charge ratios (or ranges of m/z) to be simultaneously transmitted by the mass filter whilst other ions are resonantly ejected from the mass filter or hit the radially confining electrodes. This improves the duty cycle (and hence detection limits) of the instrument. The frequencies of each (or any one) of the notches may be varied with time (e.g. scanned or stepped) so that the mass to charge ratios of each (or any one) transmission window vary with time.

Although notched broadband mass filters have been described above, the present invention may use other types of mass filter that simultaneously provide the multiple mass to charge ratio transmission windows described. For example, a quadrupole mass filter may be used wherein a mixture of RF frequencies of relatively high amplitude compared to normal resonance excitation are used to alter the Mathieu stability diagram governing ion stability within the oscillation quadrupolar potential, such that the multiple transmission windows are provided. This technique allows the introduction of multiple, controllable, bands of instability for the ions. Such a method applied to a digital quadrupole is described in "Characterization of quadrupole mass filters operated with frequency-asymmetric and amplitude-asymmetric waveforms", G. F. Brabeck et al., International Journal of Mass Spectrometry, 404 (2016) 8-13.

It will therefore be appreciated that the present invention may use a mass filter that simultaneously provides the multiple mass to charge ratio transmission windows described without broadband dipolar excitation. A mass filter using one, two, three, four, five or more quadrupolar excitation waveforms may be employed. This may produce parametric excitation of the ions that produces islands or bands of stability and instability within the main stability diagram, allowing the filter to transmit several mass to charge ratio regions simultaneously. This method may be used in conjunction with applying a resolving DC to the mass filter. The mass filter may be a harmonically driven multipole.

According to embodiments of the present invention, the mass filter having simultaneous mass to charge ratio transmission windows (e.g. notched broadband mass filter) may be used in the arrangement and method described in relation to FIG. 1. The mass filter may be used to improve the duty cycle of a scanning mass filter such as a single quadrupole or tandem quadrupole arrangement in scanning modes (i.e. precursor or parent ion scans), optionally with or without subsequent time of flight analysis of the ions.

Figure 6:
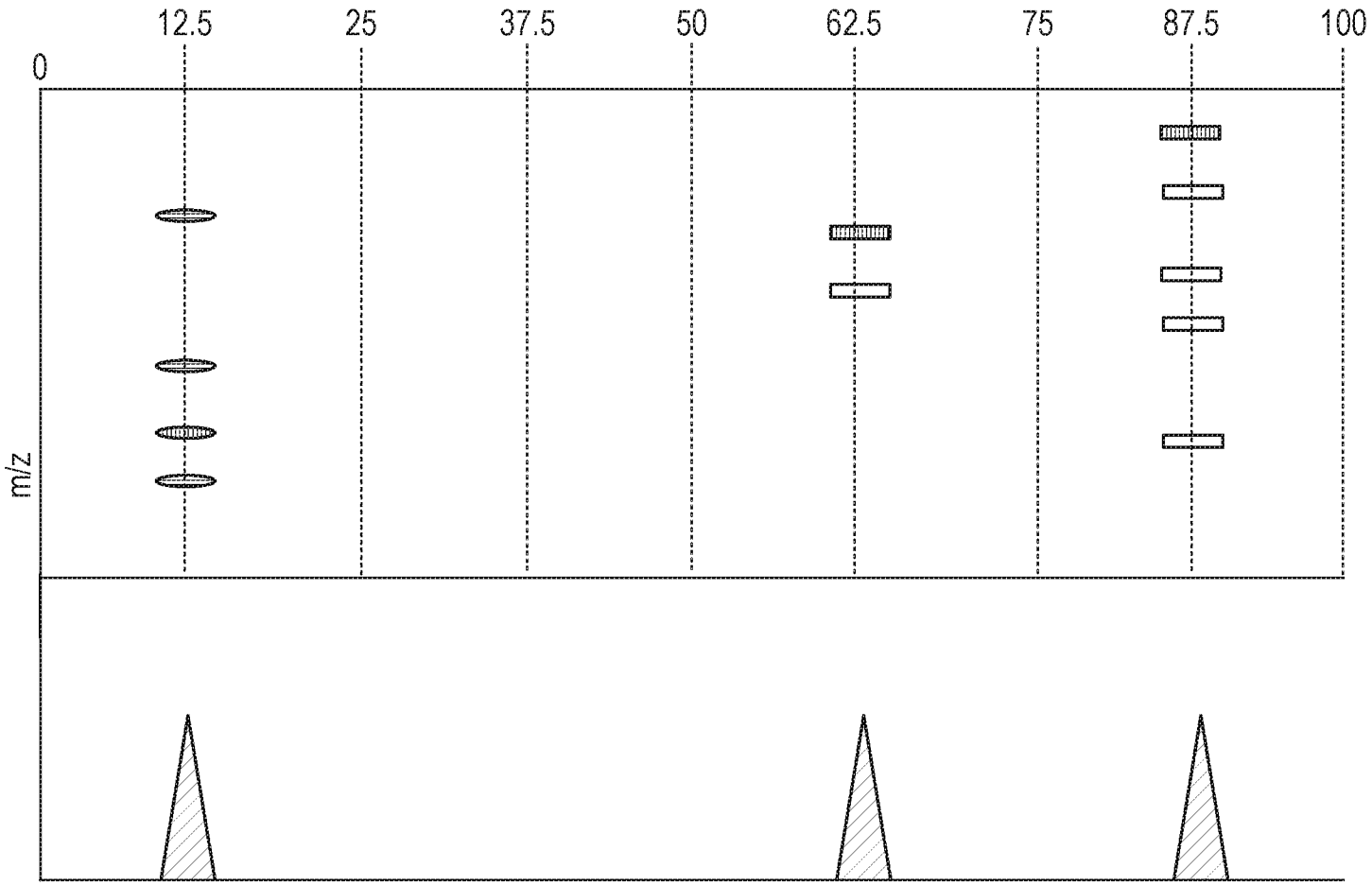
FIG. 6 shows a representation of data produced according to a prior art technique in which a quadrupole mass filter has a single mass to charge ratio transmission window that is scanned with time.

FIG. 6 shows a simplified representation of data produced according to a prior art technique in which a quadrupole mass filter has a single mass to charge ratio transmission window that is scanned with time (i.e. a mass filter of the type shown in FIG. 2). The lower trace represents the ion signal intensity detected downstream of the mass filter, as a function of the percentage of the way through the scan range that the transmission window is at. The trace therefore shows the transmission of three ions species at different times, i.e. times corresponding to 12.5%, 62.5% and 87.5% through the total mass to charge ratio scan range that is transmitted by the mass filter during the total scan time of the mass filter.

The upper trace in FIG. 6 represents the plot obtained when scanning the quadrupole in the same manner, except followed by fragmenting the transmitted ions and then mass analysing the ions in a time of flight mass analyser (i.e. using the method described in relation to FIG. 1). The upper trace shows the mass to charge ratios of the ions recorded by the time of flight mass analyser (y-axis) as a function of the percentage of the way through the scan range that the transmission window is at (x-axis). Precursor ions are represented as solid dark shapes, whereas their respective product ions are represented as lighter shapes at the same location on the x-axis. In this example, first, second and third precursor ions are sequentially transmitted when the transmission window of the mass filter is centred at a mass to charge ratio that is located at 12.5%, 62.5% and 87.5% through the total mass to charge ratio range that is transmitted by the mass filter during the total scan time of the mass filter.

Figure 7:
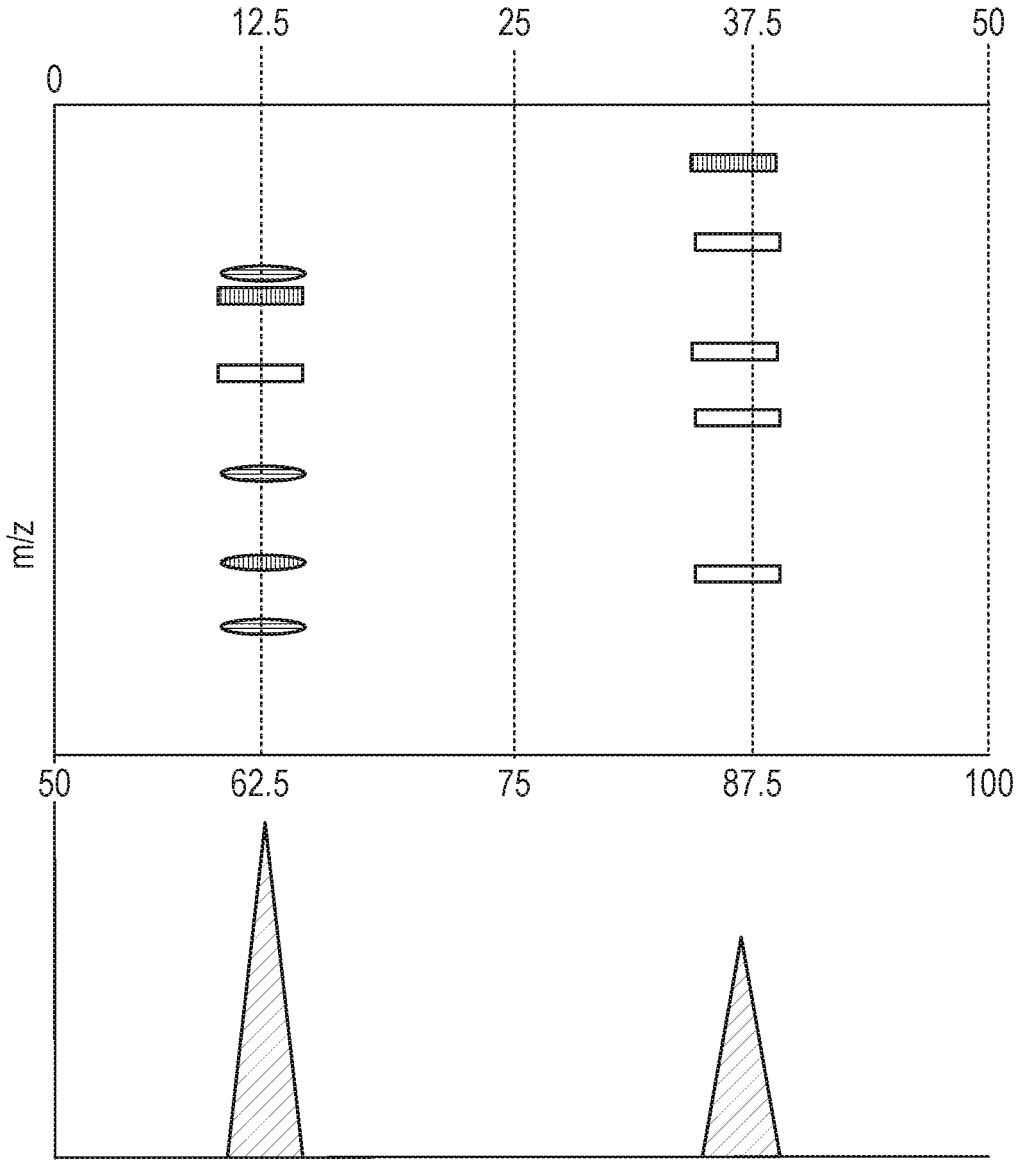
FIG. 7 shows a representation of data produced according to an embodiment of the invention in which a notched mass filter is used to provide two mass to charge ratio transmission windows that are scanned with time.

FIG. 7 shows data produced according to an embodiment of the invention that is operated in the same manner and with the same sample as described in relation to FIG. 6, except that the mass filter is a notched mass filter having two notches that generate two respective mass to charge ratio transmission windows that are simultaneously scanned with time according to mass to charge ratio. The mass to charge ratio transmission window generated by a first of the notches is scanned with time from 0 to 50% of the total mass to charge ratio range that is transmitted by the mass filter during the scanning of both notches. Simultaneously, the mass to charge ratio transmission window generated by a second of the notches is scanned with time from 50 to 100% of the total mass to charge ratio range that is transmitted by the mass filter during the scanning of both notches. As the two notches are scanned simultaneously, each over half of the total mass to charge ratio range, the duty cycle of the instrument is improved by a factor of two.

It can be seen from FIG. 7 that the first and second precursor ions are transmitted simultaneously by the first and second notches of the mass filter, respectively, at the time that the first notch creates a mass to charge ratio transmission window centred at 12.5% of the total mass to charge ratio scan range and the second notch creates a mass to charge ratio transmission window centred at 62.5% of the total mass to charge ratio scan range. The third ions are transmitted by the mass filter when the second notch creates a mass to charge ratio transmission window centred at 87.5% of the total mass to charge ratio range. It can be seen from the upper trace that the mass to charge ratios of the fragment ions (lighter shapes) may be resolved by the time of flight mass analyser. However, with this sample, it may not be possible to directly and confidently assign the fragment ions of the first and second precursor ions to their respective precursor ions, since both the first and second precursor ions are transmitted by the mass filter at the same time. It may even be difficult to determine that both the first and second precursor ions are present. Depending on the complexity of the sample, this problem may be a rare occurrence. To avoid this problem, the sample may be separated prior to ionisation (e.g. by liquid chromatography) or after ionisation (e.g. by an ion mobility separator) and the mass filter may be repetitively scanned across the scan range as the sample or ions elute or emerge from the separator. The different precursor ions will then elute or emerge from the separator at different times and so will not be transmitted by the mass filter at the same time. A given fragment ion may then be associated with its respective precursor ion based on its detection time and the time at which its precursor eluted or emerged from the separator.

In order to ensure identification is accurate, one or more further scan may be performed during the elution time under different scanning conditions. Examples of different scanning conditions are described below, such as scanning the various notches over different ranges or in different directions.

Figure 8:
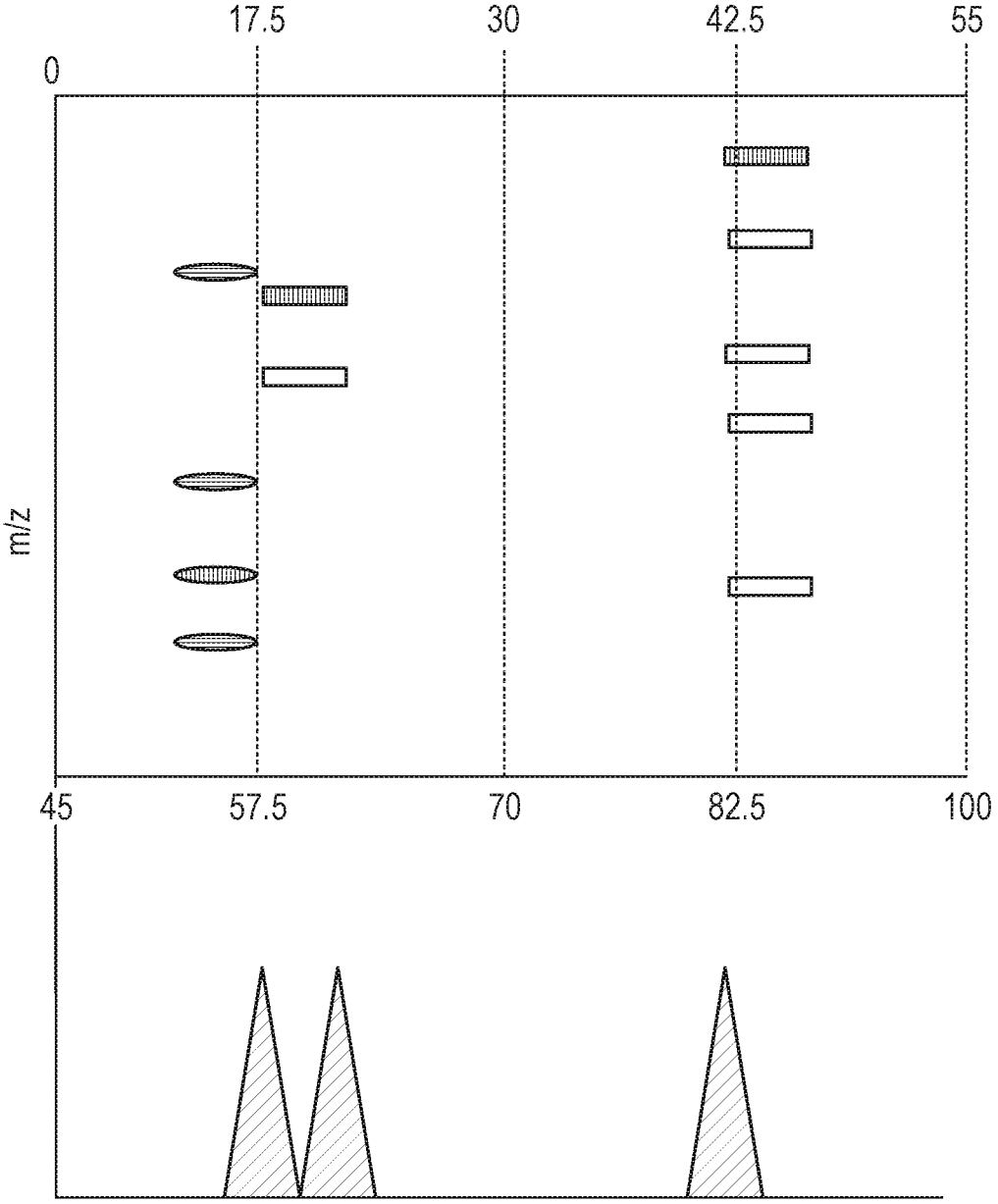
FIG. 8 shows a representation of data produced according to another embodiment in which the mass to charge ratio transmission windows are scanned over different ranges that partially overlap.

FIG. 8 shows data produced according to an alternative embodiment of the invention. This is operated in the same manner and with the same sample as described in relation to FIG. 7, except that the mass to charge ratio transmission window generated by a first of the notches is scanned with time from 0 to 55% of the total mass to charge ratio range and the second of the notches is scanned with time from 45 to 100% of the total mass to charge ratio range. As the scan ranges of the two notches overlap, the duty cycle of the instrument is improved by a factor of 1.8 as compared to the conventional mass filter used in FIG. 6. It can be seen from FIG. 8 that the first and second precursor ions no longer overlap as they are not transmitted by the mass filter at the same time, and so can be resolved. As the time at which each notch passes each mass to charge range is known, the relationship between the positions of the peaks in the pairs of spectra may be used to reconstruct a full mass spectrum. For example, each precursor ion may be associated with its respective fragment ions based on the transmission time of the precursor ion and the detection times of the fragment ions. As described previously, a sample or ion separator may be used to confirm the assignment between a fragment and a precursor.

Therefore, in embodiments of the invention at least two data sets may be acquired in at least two scans. The two scans are acquired with different mass to charge ratio scan characteristics and the subsequently acquired data may then be de-convoluted to produce a single data set representing the composition of the ion population.

Although two embodiments have been described with different scan characteristics, many other scan functions are envisaged. For example, notches 1 and 2 may be scanned in opposite directions, e.g. notch 1 may be scanned from 0 to 50% of the full mass to charge ratio range while notch 2 is scanned from 100% to 50% of the full range. Referring back to FIG. 7, reversing the direction of the notch 2 scan would result in the three precursor ions being transmitted at different times and being resolved, rather than the first and second precursor ions being transmitted at the same time.

Alternatively, or additionally to scanning the notches in different directions, the different notches may be scanned at different rates. This produces peaks of different widths, enabling different ions that are transmitted simultaneously by different notches of the mass filter to be distinguished.

Figure 9:
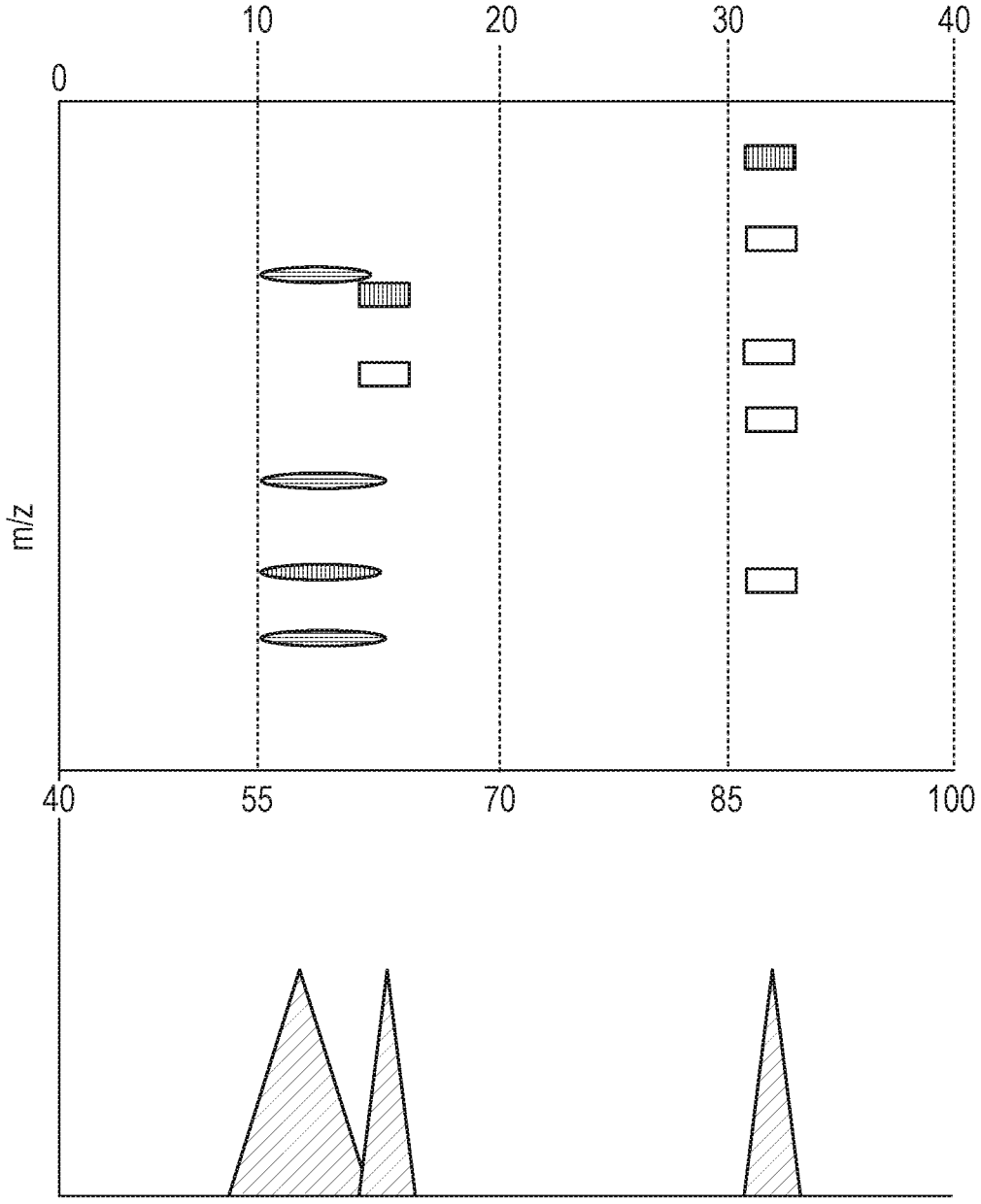
FIG. 9 shows a representation of data produced according to another embodiment in which the mass to charge ratio transmission windows are scanned over ranges of different size.

FIG. 9 shows data produced according to an alternative embodiment of the invention. This is operated in the same manner and with the same sample as described in relation to FIG. 7, except that the mass to charge ratio transmission window generated by the first notch is scanned with time from 0 to 40% of the total mass to charge ratio range during the same time period that the second notch is scanned from 40 to 100% of the total mass to charge ratio range. Notch 1 is therefore scanned over 40% of the total mass to charge ratio range, whereas notch 2 is scanned over 60% but at a faster rate. As notch 2 is scanned faster than notch 1 and over a range that is 1.5 times larger than the range over which notch 1 is scanned, the peaks produced by notch 1 will be 1.5 times wider than those from notch 2. This difference in peak width enables one to determine which ions were transmitted by which notch (or are derived from those ions). For example, in FIG. 9 it can be seen that the first precursor ion transmitted during the slow scan of notch 1 at 12.5% of the scan range (and its fragment ions) has a relatively wide peak, as compared to the second and third precursor ions transmitted by the fast scan of notch 2 at 62.5% and 87.5% of the scan range (and their fragment ions). This differences in peak width may therefore be used to identify the origin of the peaks in the MS or MS-MS spectra.

In this approach, association of precursor ions and fragment ions is possible by deconvolution of a single scan using information from the width and/or shape of the quadrupole scan peaks and the time at which the peak appears in the quadrupole scan for each mass to charge ratio value detected by the time of flight mass spectrometer. As described previously, a sample or ion separator may be used to add more specificity to the assigning of product ions to precursors.

Other variations on this approach are envisaged, such varying the fixed m/z width of the different notches or varying the width of the notches with time.

Figure 10:
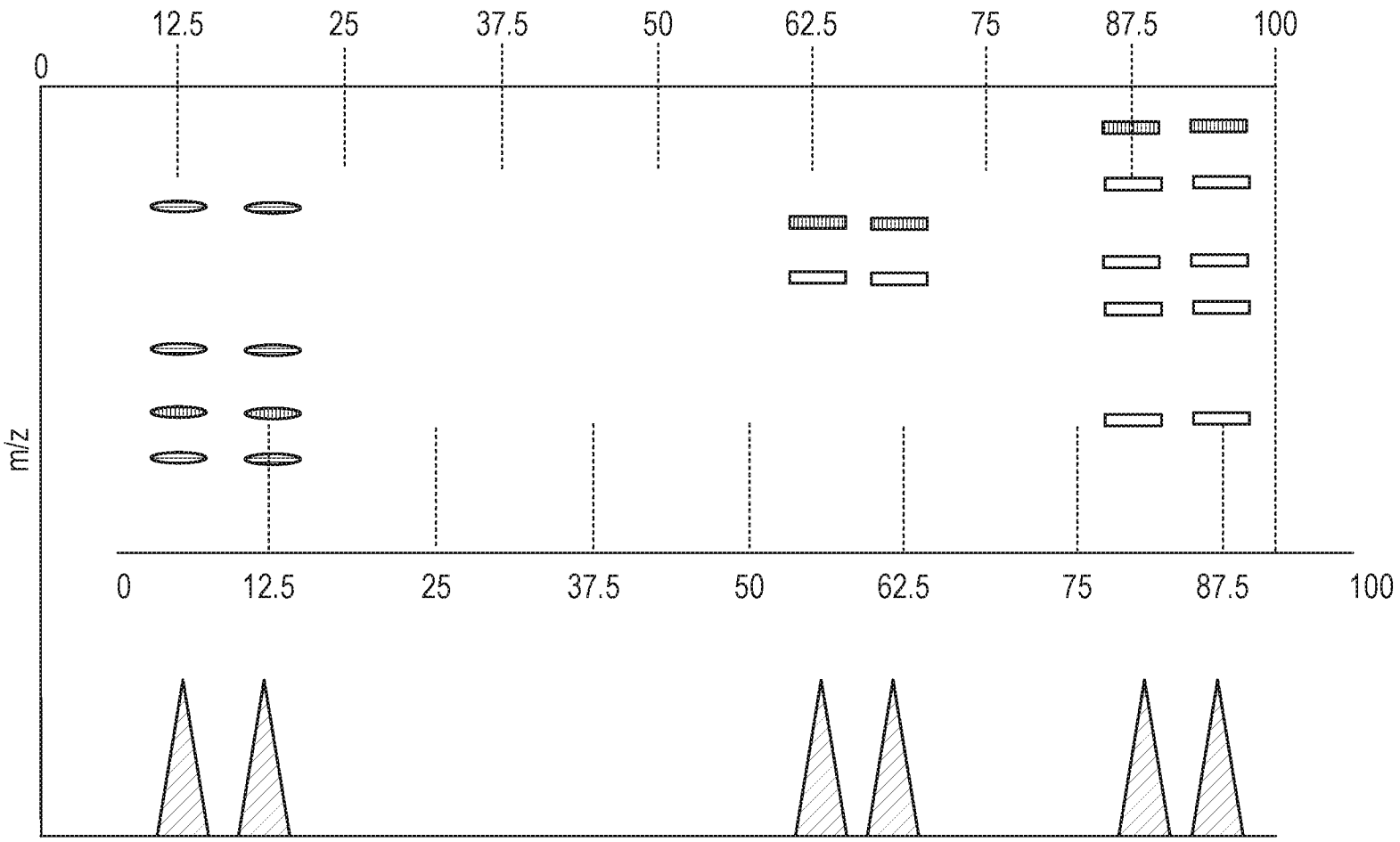
FIG. 10 shows a representation of data produced according to another embodiment in which the mass to charge ratio transmission windows are scanned over the same range, but with a delay between the scans.

FIG. 10 shows data produced according to an alternative embodiment of the invention. This is operated in the same manner and with the same sample as described in relation to FIG. 7, except that both notches are scanned from 0 to 100% of the total mass to charge ratio range and there is a delay between the start of the scan of the first notch and the start of the scan of the second notch. FIG. 10 shows the data from both notches aligned relative a reference time. As can be seen, two peaks appear in the data for each mass to charge ratio species, wherein these two peaks are separated by a time difference corresponding to the delay between starting the first and second scans (as the notches are scanned at the same rate). As the time difference is known, the data may be de-convoluted to produce a single spectra with enhanced duty cycle.

Although only two notches are described in this embodiment, it is contemplated that three or more notches may be scanned. Each notch may have a different start time for its scan and/or different speed and/or different direction, thereby increasing the duty cycle further. The resulting spectrum may be de-convoluted based on the known start times and/or speed and/or direction.

Figure 11:
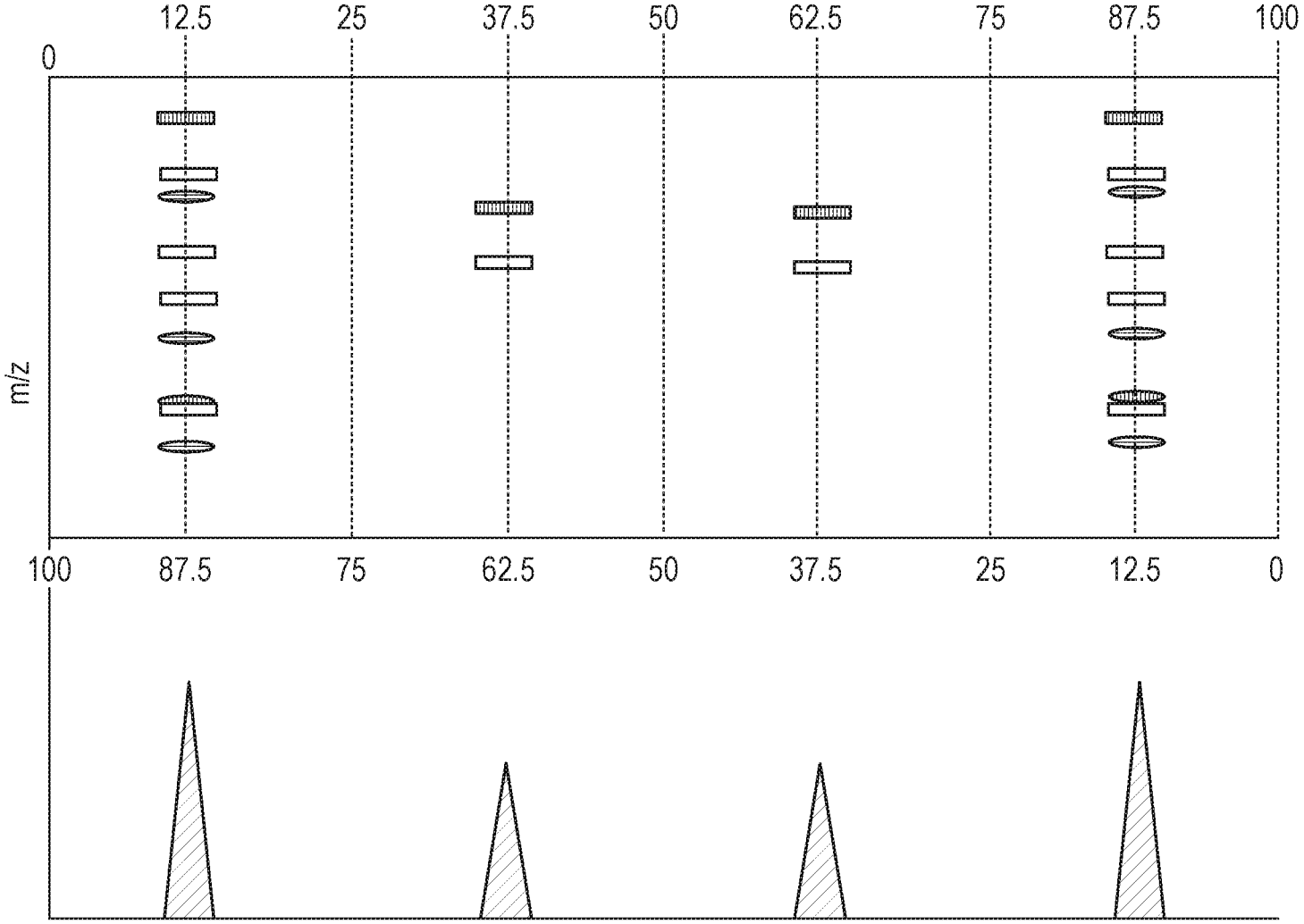
FIG. 11 shows a representation of data produced according to another embodiment in which the mass to charge ratio transmission windows are scanned over the same range, but in different directions.

FIG. 11 shows data produced according to an alternative embodiment of the invention. This is operated in the same manner and with the same sample as described in relation to FIG. 7, except that both notches are scanned from 0 to 100% of the total mass to charge ratio range and in different directions, i.e. notch 1 is scanned from 0-100% whilst notch 2 is simultaneously scanned from 100-0%. The pairs of peaks produced by the two notches again have positions characteristic of the two scan laws.

The various methods described herein may be combined.

As described above, the use of multiple notches increases the duty cycle of the instrument for a given total scan time, as fewer ions are discarded as compared to when a single notch is used. For example, if the notches scan different parts of the range of interest (e.g. as in FIG. 7), they may each be scanned at a relatively slow rate since each notch need not scan the whole range of interest during the total scan time and hence a greater number of ions will be transmitted than if a single notch was scanned over the entire range of interest. Also, if each of the notches scan the same range (e.g. as in FIG. 10), the multiple notches transmit a greater combined number of ions than a single notch would during the same total scan time. As a greater number of ions are transmitted, the resulting data can be analysed to obtain more precise spectral data and with a better signal to noise ratio.

However, as the multiple notches are capable of simultaneously transmitting ions (at least for some of the total scan time), the detector signals resulting from the use of multiple notches overlap. Embodiments of the present invention deconvolve the signals resulting from the different notches.

Various approaches to deconvolving the final data set obtained from the multiple notch scans are envisaged including, for example, Bayesian methods, Maximum Entropy, the "cleaner" algorithm, Hadamard transforms, Non-Negative Least Squares (NNLS) deconvolution, Fourier transform, wavelet deconvolution, nested sampling deconvolution, and (regularised) least squares deconvolution etc.

Desirably, a forward modelling deconvolution algorithm is used to deconvolve the data/signals resulting from the multiple notches.

In such forward modelling techniques, the method comprises modelling ion signals expected to be detected at the detector given a plurality of species of ion being provided to the mass filter, so as to provide a plurality of respective model signal. The model signals are superimposed and then compared to the ion signal from the detector to determine if they match. This process is then repeated, except wherein at least one of the mass to charge ratios and/or at least one of the intensities in the model signal is varied before superimposing the model signals and comparing the composite model signal to the detector signal. This process is repeated in an iterative manner for model signals that model different mass to charge ratios and/or intensities until the superimposed composite model signal is determined to match the detector signal to within a predetermined tolerance or criteria. The detector signal data is then determined to have been obtained due to the notches transmitting ions having the mass to charge ratios and intensities of the ions in the model signals that have been matched to the detector signal.

The forward modelling method results in determination of intensity and mass to charge ratio (i.e. notch transmission time) to a high precision and with better signal to noise ratio of the recovered signal as compared to a simple peak detection or peak location approach, since more information contained within the signal may be utilised to produce a single measurement of an ion's mass to charge ratio (i.e. notch transmission time).

If the precursor ions transmitted by the notches are substantially unfragmented or unreacted prior to detection, then the experimentally obtained signal and the model signals represent the mass to charge ratios (i.e. notch transmission times) and intensities of those precursor ions.

On the other hand, if the precursor ions transmitted by the notches are fragmented or reacted to produce fragment or product ions, the experimentally obtained signal is the signal resulting from detecting those fragment or product ions. Such fragmentation or reaction of the precursor ions is accounted for when modelling the model signals expected at the detector. The mass to charge ratios (i.e. notch transmission times) and intensities of those precursor ions may therefore be determined even though fragment or product ions are detected rather than the precursor ions themselves.

The fragment or product ions may be mass analysed to determine their mass to charge ratios. These fragment or product ions may be associated with their precursor ions based on the time of detection of the fragment or product ions and how the mass to charge ratios capable of being transmitted by the notches vary with time. For example, if it has been determined from the model signals that a particular precursor ion was transmitted by a notch, then a fragment or product ion detected may be determined to be associated with that precursor ion if the fragment or product ion is detected at substantially the same time that the precursor ion is capable of being transmitted by one or the notches.

Although such forward fitting techniques are computationally relatively expensive, advances in computational electronics and methods have made these techniques more practical.

Furthermore, the notched mass filter may be coupled with a time of flight mass separator to simplify the application of these forward fitting techniques. Forward fitting of model data may be applied to signals from narrow mass to charge ratio regions of the time of flight spectra, in which relatively few species exist and therefore the signal is greatly simplified, resulting in more precise results in shorter timescales.

The forward modelling techniques described are particularly useful as they are able to deconvolve overlapping signals from common or non-m/z resolved fragment or product ions arising from precursor ions having similar mass to charge ratios.

The model signal data may be obtained using calibration standards or using sufficiently pure species within the analyte mixture itself.

From the known line width and relative m/z transmission windows of the notches during the scan, a full spectrum may be produced with increased sensitivity and signal to noise.

FIGS. 12 and 13 show examples demonstrating the improvement in signal to noise ratio that can be achieved by simultaneously using multiple notches and a forward modelling deconvolution technique.

FIGS. 12A-12D show the effect of using a non-negative least squares de-convolution technique on simulated data representing that which would be obtained by scanning a single transmission window according to conventional techniques, and on simulated data representing that which would be obtained by scanning multiple transmission windows (notches) according to the embodiment described in relation to FIG. 10.

Figure 12A:
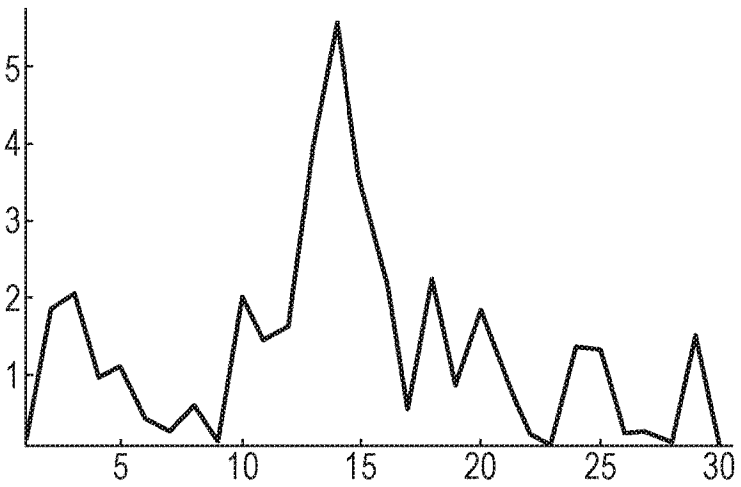
FIGS. 12A-12D show a comparison between data obtained by a conventional technique and a technique according to an embodiment of the invention.

FIG. 12A is simulated data representing a scan of a single mass to charge ratio transmission window according to a conventional technique. The data was generated by convolving the point spread function 1,3,5,3,1 for the quadrupole band pass with a delta function representing the position of the data in the x axis. In x-y coordinates the data is at bin 15 with an intensity of 1 (15,1). Random noise with a standard deviation of 1 was then added after convolution.

Figure 12B:
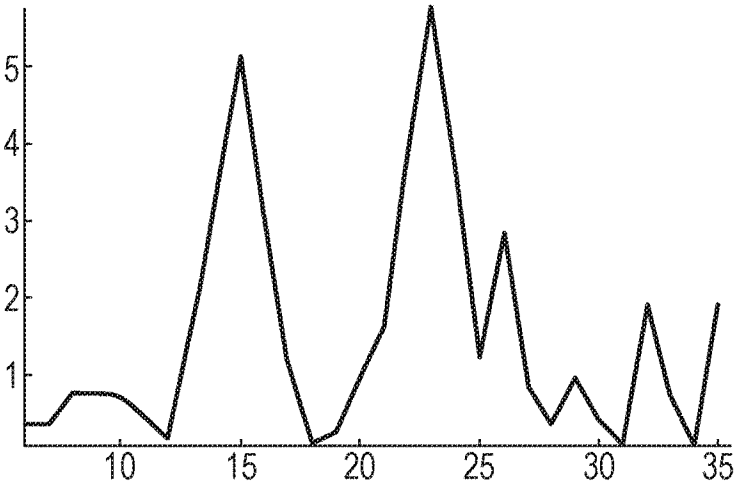

FIG. 12B represents the same data as FIG. 12A but for the scanning of two mass to charge ratio transmission windows, with the start time of the scan of the second transmission window delayed by 8 time bins with respect to the start time of the scan of the second transmission window (i.e. according to the technique described in relation to FIG. 10). The point spread function used was 1,3,5,3,1,0,0,0,1,3,5,3,1. As can be seen from FIG. 12B, two peaks appear in the spectra as the species at (15,1) is transmitted twice.

Figure 12C:
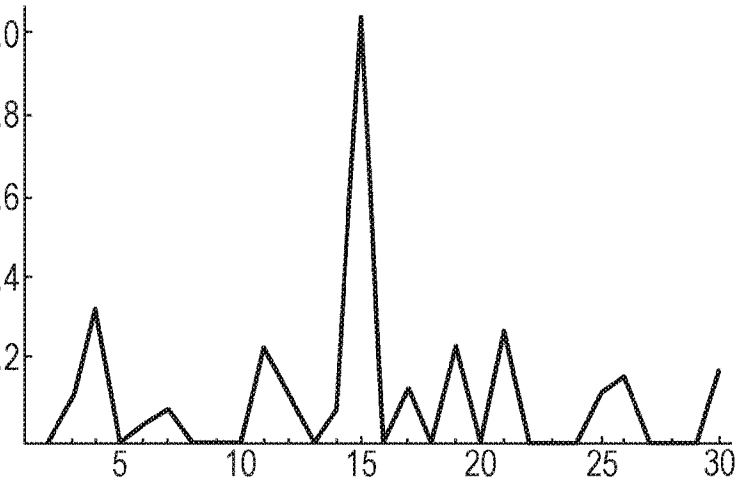
Figure 12D:
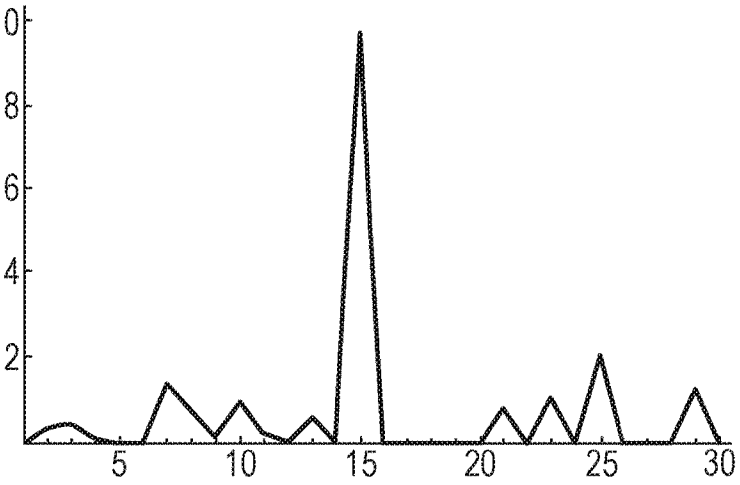

FIG. 12C shows the de-convoluted data of FIG. 12A using a forward modelling non-negative least squares method, and FIG. 12D shows the de-convoluted data of FIG. 12B using a forward modelling non-negative least squares method. In these simple examples the modelled expected signal shape used in the forward fitting deconvolution was set to be the point spread functions described for generation of the simulated data for FIGS. 12A and 12B. It can be seen that the signal to noise ratio in the de-convoluted data of FIG. 12D is clearly improved when the double notch embodiment is employed, as compared to the de-convoluted data of FIG. 12C. Statistical precision of both the intensity and the peak position are also improved. The improvement in signal to noise and peak position in the deconvoluted data of FIG. 12D arises from the ability of the forward modelling approach to utilise the signal from both of the m/z transmission windows simultaneously. A simple centroid or other peak detection technique applied to each of the two peaks in FIG. 12B would not realise this gain in signal to noise ratio.

FIGS. 12A-12D illustrate a simple example of the forward modelling approach to data recovery using simulated data. The data in FIG. 12 may be viewed in the context of the mass spectrometry application of determining precise peak location for precursor ions and/or product ions formed downstream of the mass filter. The data in FIGS. 12A and 12B represent the m/z chromatogram associated with a narrow m/z range, isolated within the time of flight spectra, formed by scanning the mass filter over this m/z range.

Figure 13A:
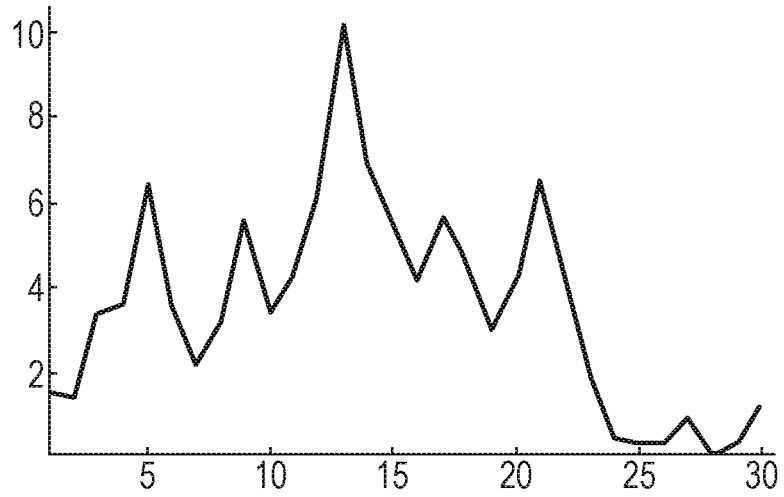
FIGS. 13A-13B show raw model data and de-convoluted data according to an embodiment of the invention.
Figure 13B:
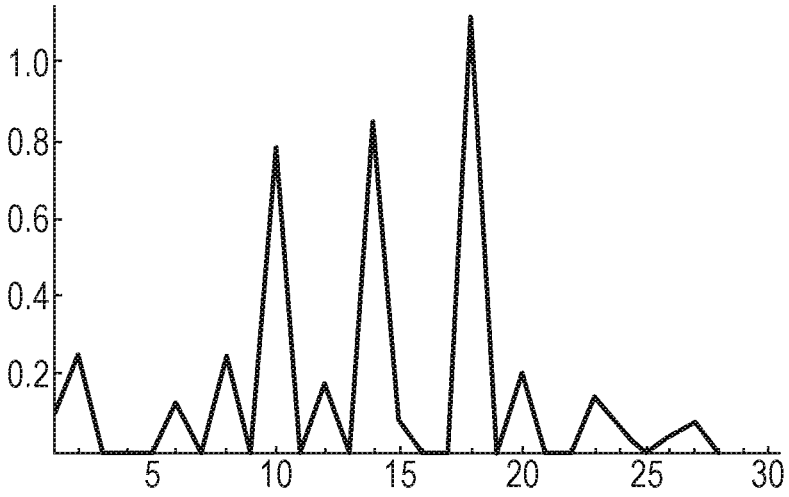

The position of the peak determined in FIGS. 12C and 12D by the forward modelling approach may be used to assign the m/z value of the precursor ion or to associate the precursor ion with its respective product ions, which will also appear as a peak in the deconvolved data at this time. Increasing the precision of the measurement using multiple m/z transmission windows improves the precision of this association. FIGS. 13A and 13B show similar data for simultaneously scanning two mass to charge ratio transmission windows as described for FIG. 12B, except in this case three data points are present representing three different m/z species. FIG. 13A shows the raw simulated data and FIG. 13B shows the de-convoluted data having three data points (10,1), (15,1) and (18,1). This demonstrates the ability of the forward modelling algorithm to extract high quality data from the complex raw data produced by simultaneously scanning multiple m/z ranges. This type of data may be produced, for example, in situations where three precursor ions of different m/z give rise to a common product ion.

Although the present invention has been described with reference to preferred embodiments, it will be understood by those skilled in the art that various changes in form and detail may be made without departing from the scope of the invention as set forth in the accompanying claims.

For example, although embodiments have been described in which two notches are scanned such that two mass to charge ratio transmission windows are scanned, it is contemplated that three, four, five or more notches may be used to simultaneously scan mass to charge ratio windows over three, four, five or more respective different portions of the mass to charge ratio range.

The ions transmitted by the mass filter may be passed to a fragmentation, dissociation or reaction region and the level of fragmentation, dissociation or reaction in this region may be varied with time, e.g. alternated between a high and low level such as, for example, the ions are alternated between being fragmented, dissociated or reacted and not being fragmented, dissociated or reacted. Alternatively, the ions transmitted by the mass filter may be onwardly transmitted such that they alternate between passing into a fragmentation, dissociation or reaction region and bypassing such a region. This allows, for example, the ions to be alternated between being fragmented, dissociated or reacted and not being fragmented, dissociated or reacted.

It is contemplated that, at least in a mode of operation, the mass to charge ratio of an ion transmitted by the mass filter may be determined directly by determining the time that the filter transmitted the ion and the mass to charge ratio of the transmission window at that time (optionally after mass calibration of the transmission window).

It is contemplated that the sample may be separated prior to ionisation (e.g. by liquid chromatography) or after ionisation (e.g. by an ion mobility separator) and then passed to the mass filter. The mass filter may be repetitively scanned across the scan range as the sample or ions elute or emerge from the separator. The different precursor ions will then elute or emerge from the separator at different times and so will not be transmitted by the filter at the same time. A given fragment ion may be associated with its respective precursor ion based on its detection time and the time at which its precursor eluted or emerged from the separator.

A nested MS or MS-MS, IMS data set may be produced, further increasing specificity reducing overlap of peaks and allowing clearer assignment of precursor ion mass to charge ratio.

The method described herein may be used to add more specificity at constant duty cycle by allowing the use of multiple narrow m/z transmission windows, or to increase the overall duty cycle (e.g. at the same specificity as described).

It is contemplated that the scanning of the m/z transmission windows may be linked to ramping or scanning other operational parameters of the system, e.g. in order to optimize performance. For example, the ions transmitted by the filter may be subjected to fragmentation (e.g. in a CID collision cell) and the level of fragmentation or fragmentation energy may be scanned along with the m/z transmission window.

The number and/or range and/or scan speed of the notches may be varied with time in a pre-determined way or based on information about the sample, e.g. based on the results of one or more previous experiments or data already acquired during the current experiment (for example the m/z distribution of precursors in low energy data).

The notches may move non-linearly in m/z as a function of scan time, and/or they may also move discontinuously with scan time. Where changes in notch parameters induces transition artefacts (e.g. due to rapid changes in notch parameters), the affected data may be discarded or suppressed.

The technique disclosed herein may be used to improve the duty cycle of a scanning mass filter such as a single quadrupole or tandem quadrupole in scanning modes (i.e. precursor or parent ion scans) without subsequent time of flight analysis.

Although notched broadband mass filters have been described above, the present invention may use other types of mass filter that simultaneously provide the multiple mass to charge ratio transmission windows described. For example, a quadrupole mass filter may be used wherein a mixture of RF frequencies of relatively high amplitude compared to normal resonance excitation are used to alter the Mathieu stability diagram governing ion stability within the oscillation quadrupolar potential, such that the multiple transmission windows are provided. This technique allows the introduction of multiple, controllable, bands of instability for the ions.

It is also contemplated that the methods described herein may be used with an ion trap. In this case the above-described mass to charge ratio transmission windows correspond to windows of mass to charge ratios that are ejected from the ion trap. In other words, two or more excitation frequencies may be applied to the ion trap for simultaneously ejecting multiple m/z ranges from the trap, and these excitation frequencies may be scanned or stepped with time so that the m/z ranges of the ejected ions vary with time. This allows the total time required to scan all ions out of the ion trap to be decreased without increasing the speed of scanning and hence without loss of mass resolution. The cycle time of filling and emptying the ion trap may therefore be increased, thus increasing the overall dynamic range of the analysis by increasing the total amount on charge which can be analysed during multiple fill/eject cycles. The ejected ions may be processed and analysed in corresponding manners to those described above in relation to the mass filter embodiments.

Although forward fitting techniques have been described for deconvolutin of the ion signal, it is contemplated that other techniques of deconvolution may be used. For example, a least squares technique may be used where an inverse, as opposed to forwards, approach may be used. A single linear operator may be sought which will transform the raw spectrum into a deconvolved spectrum. Various regularisation techniques may be used to avoid the singularities that arise and prevent over-fitting. Alternatively, nested sampling may be used, which is a computational technique that may be applied to the least squares or Bayesian techniques described herein.

The invention claimed is:

1. A method of mass spectrometry comprising:

providing ions to a mass filter or ion trap;

applying voltages to the mass filter or ion trap such that it is capable of transmitting or ejecting ions having mass to charge ratios within separate first and second mass to charge ratio windows;

varying said voltages with time such that the first and second windows are moved simultaneously across different ranges of mass to charge ratio;

detecting ions transmitted or ejected in the first and second mass to charge ratio windows, or ions derived therefrom, with an ion detector to obtain an ion signal; and deconvolving the ion signal detected at the detector, wherein said deconvolving comprises:

a) modelling at least one ion signal expected to be detected at the detector given at least one respective species of ion being provided to the mass filter or ion trap, so as to provide at least one respective model signal;

b) comparing the at least one model signal to the ion signal from the detector; and c) determining if the at least one model signal matches the ion signal from the detector.

2. The method of claim 1, wherein step a) comprises empirically modelling said at least one ion signal by:

providing one or more known ion species to the mass filter or ion trap;

measuring the ion signal detected at the detector in response thereto;

using the measured ion signal for the one or more known species as the model signal for that respective species.

3. The method of claim 1, wherein steps a) and b) comprise:

defining or obtaining model signals for a plurality of said species of ions; superimposing the model signals to form a composite model signal; and comparing the composite signal to the ion signal from the detector; or defining or obtaining a model signal for only a single species of ion as a composite model signal, and comparing that signal to the ion signal from the detector.

4. The method of claim 3, comprising:

calculating a goodness of fit between the composite model signal and the ion signal from the detector;

wherein if the goodness of fit indicates that the composite model signal and said ion signal match to within a predetermined convergence criterion, then the composite model signal is considered to match the ion signal.

5. The method of claim 4, wherein the method is an iterative method comprising the steps of : (i) modifying the amplitude and/or mass to charge ratio of one or more of said at least one species of ions modelled to provide said at least one model signal, (ii) comparing the resulting composite signal to the ion signal output from the detector, and (iii) calculating a goodness of fit between this composite signal and the ion signal output from the detector;

wherein steps (i)-(iii) are repeatedly performed in an iterative manner until the goodness of fit between the composite signal and the ion signal output from the detector match to within said convergence criterion.

6. The method of claim 3, wherein when the composite model signal is considered to match the ion signal then said plurality of said species of ions, or said single species of ion, is determined to have been transmitted or ejected by the first and/or second windows.

7. The method of claim 6, comprising determining the mass to charge ratio of each of said species of ions determined to have been transmitted or ejected from its respective model signal; and optionally also determining the intensity of each of said species of ions determined to have been transmitted from its respective model signal.

8. The method of claim 6, comprising determining, from its respective model signal, the time of transmission or ejection by said first and/or second windows of each of said species of ions that has been determined to have been transmitted or ejected.

9. The method of claim 1, wherein the ions transmitted or ejected by the first and second windows are fragmented and/or reacted to produce fragment and/or product ions that are then detected by the ion detector to produce said ion signal; the method comprising:

(i) associating at least one of the fragment and/or product ions with its respective precursor ions transmitted or ejected by the first and/or second window based on the time of detection of the fragment and/or product ions and on how the mass to charge ratios capable of being transmitted or ejected in the first and/or second windows vary with time; and/or (ii) associating at least one of the species of ions determined to have been transmitted by the first and/or second window with its respective fragment and/or product ions by matching the intensity profile shape of the model signal for this ion species with the intensity profile shape of the fragment and/or product ions detected at the detector.

10. The method of claim 1, wherein the ion detector is the detector of a time or flight mass analyser, or wherein the method comprises separating ions according to mass to charge ratio between said mass filter or ion trap and said ion detector; and wherein the ion signal is filtered or otherwise processed to isolate a first portion of the ion signal that is associated with ions having a first range of mass to charge ratios, and wherein said deconvolving is then applied to said first portion of the ion signal.

11. The method of claim 1, wherein either:

(i) the mass filter is a notched mass filter, wherein a broadband frequency AC or RF voltage signal is applied to electrodes of the filter for exciting and ejecting ions from the filter, wherein said first and second windows are provided by arranging notches in the broadband frequency signal such that frequencies are absent from the broadband frequency signal, and wherein the values of the notched frequencies are varied with time such that the first and second windows move with time; or (ii) the ion trap is a mass selective ion trap, wherein first voltages are applied to electrodes of the ion trap to trap ions therein, wherein said first and second windows are provided by applying AC or RF voltages to electrodes of the ion trap for exciting and ejecting ions from the ion trap, and wherein the frequencies of the AC or RF voltages are varied with time such that the first and second windows move with time.

12. A mass spectrometer configured to perform the method of claim 1.

13. A method of mass spectrometry comprising:

providing ions to a mass filter or ion trap;

applying voltages to the mass filter or ion trap such that it is capable of transmitting or ejecting ions having mass to charge ratios within separate first and second mass to charge ratio windows;

varying said voltages with time such that the first and second windows are moved simultaneously across different ranges of mass to charge ratio; and detecting ions transmitted or ejected in the first and second mass to charge ratio windows, or ions derived therefrom, with an ion detector to obtain an ion signal.

14. The method of claim 13, wherein the first window is moved over a first range of mass to charge ratios and the second window is moved over a second range of mass to charge ratios, wherein the first and second ranges at least partially overlap.

15. The method of claim 13, wherein the first window is moved over a first range of mass to charge ratios and the second window is moved over a second different range of mass to charge ratios, wherein the first and second ranges do not overlap.

16. The method of claim 13, wherein the first window is moved over a first range of mass to charge ratios and the second window is moved over a second different range of mass to charge ratios, wherein the first and second ranges are different sizes.

17. The method of claim 13, wherein the first window is moved over a first range of mass to charge ratios during a first time period and the second window is moved over a second range of mass to charge ratios during a second time period, wherein the second time period commences after the first time period commences; and/or wherein the second time period ends either before or after the first time period ends.

18. The method of claim 13, wherein one of the first and second windows moves in a direction of increasing mass to charge ratio and the other of the first and second windows moves in a direction of decreasing mass to charge ratio.

19. The method of claim 13, wherein the first and second windows are moved at different rates.

20. The method of claim 13, wherein the width of the first window is different to the width of the second window.

* * * * *